US010351975B2

(12) United States Patent
Gao et al.

(10) Patent No.: US 10,351,975 B2
(45) **Date of Patent: *Jul. 16, 2019**

(54) METHOD AND DEVICE OF DYNAMICALLY CONFIGURING LINEAR DENSITY AND BLENDING RATIO OF YARN BY FOUR-INGREDIENT ASYNCHRONOUS/SYNCHRONOUS DRAFTED

(71) Applicant: JIANGNAN UNIVERSITY, Wuxi (CN)

(72) Inventors: Weidong Gao, Wuxi (CN); Yuan Xue, Wuxi (CN); Mingrui Guo, Wuxi (CN); Jian Zhou, Wuxi (CN); Ruihua Yang, Wuxi (CN); Hongbo Wang, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 219 days.

This patent is subject to a terminal disclaimer.

(21) Appl. No.: 15/306,762

(22) PCT Filed: Jul. 27, 2015

(86) PCT No.: PCT/CN2015/085214

§ 371 (c)(1),
(2) Date: Oct. 26, 2016

(87) PCT Pub. No.: WO2016/155163

PCT Pub. Date: Oct. 6, 2016

(65) Prior Publication Data

US 2017/0051439 A1 Feb. 23, 2017

(30) Foreign Application Priority Data

Mar. 27, 2015 (CN) ..... 2015 1 0141427
Mar. 27, 2015 (CN) ..... 2015 1 0141818
Mar. 27, 2015 (CN) ..... 2015 1 0142129

(51) Int. Cl.
*D01H 5/36* (2006.01)
*D01H 5/74* (2006.01)

(52) U.S. Cl.
CPC ..... *D01H 5/36* (2013.01); *D01H 5/74* (2013.01)

(58) Field of Classification Search
CPC .. D01H 5/22; D01H 5/32; D01H 5/36; D01H 5/74–82
See application file for complete search history.

(56) References Cited

U.S. PATENT DOCUMENTS 46,896 A * 3/1865 Goodspeed ..... B65H 27/00 492/39
2,198,279 A * 4/1940 Weinberger ..... D01H 5/74 19/258

(Continued)

FOREIGN PATENT DOCUMENTS

CN 1336453 A 2/2002
CN 102031600 A 4/2011

(Continued)

*Primary Examiner* — Shaun R Hurley
(74) *Attorney, Agent, or Firm* — Gokalp Bayramoglu

(57) ABSTRACT

A device includes a drafting and twisting system. The drafting and twisting system includes a first stage drafting unit, a successive second stage drafting unit and an integrating and twisting unit. The first stage drafting unit includes a combination of back rollers and a middle roller. The second stage drafting unit includes a front roller and the middle roller. Blending proportion and linear densities of the four ingredients are dynamically adjusted by the first stage asynchronous drafting mechanism, and reference linear density is adjusted by the second stage synchronous drafting mechanism. The invention can not only accurately control a linear density change, but also accurately control color change of the yarn. Further, rotation rate of the middle roller (Continued)

is constant, ensuring a reproducibility of patterns and colors of the yarn with changing linear density.

21 Claims, 3 Drawing Sheets

(56) References Cited

U.S. PATENT DOCUMENTS 2,991,514 A * 7/1961 Cotchett ..... D01H 5/76 19/295
3,020,697 A * 2/1962 Sherman ..... D02G 3/346 19/288
3,599,305 A * 8/1971 Aurich ..... H01H 36/00 100/917
5,161,284 A * 11/1992 Leifeld ..... D01H 1/22 19/243
5,343,598 A * 9/1994 Hauner ..... D01G 15/46 19/150
5,774,943 A * 7/1998 Clapp ..... D01H 5/46 19/240
5,796,220 A * 8/1998 Clapp ..... D01H 5/42 19/157
6,021,548 A * 2/2000 Temburg ..... D01H 13/04 19/150
6,182,333 B1 * 2/2001 Lauhus ..... D01H 5/80 19/236
6,289,599 B1 * 9/2001 Leifeld ..... B65H 63/062 19/23
2017/0067188 A1 * 3/2017 Xue ..... D01H 5/22
2017/0073849 A1 * 3/2017 Gao ..... D01H 5/36
2017/0268134 A1 * 9/2017 Xue ..... D01H 5/36

FOREIGN PATENT DOCUMENTS

CN 102995174 A 3/2013
CN 203795057 U 8/2014
CN 104726975 A 6/2015
CN 104726990 A 6/2015
CN 204530069 U 8/2015
WO WO2015033811 A1 3/2015

* cited by examiner

METHOD AND DEVICE OF DYNAMICALLY CONFIGURING LINEAR DENSITY AND BLENDING RATIO OF YARN BY FOUR-INGREDIENT ASYNCHRONOUS/SYNCHRONOUS DRAFTED

CROSS REFERENCE TO RELATED APPLICATIONS

This application is a national phase entry application of International Application No. PCT/CN2015/085214, filed on Jul. 27, 2015, which is based upon and claims priority to NO. CN201510142129.0, filed on Mar. 27, 2015, claims another priority to NO. CN201510141818.X, filed on Mar. 27, 2015, and claims a third priority to NO. CN201510141427.8, filed on Mar. 27, 2015, the entire contents of which are incorporated herein by reference.

TECHNICAL FIELD

The invention relates to a ring spinning filed of a textile industry, and particularly relates to a method and device of dynamically configuring linear density and blending ratio of yarn by four-ingredient asynchronous drafted.

BACKGROUND

Yarn is a long and thin fiber assembly formed by orienting in parallel and twisting of fiber. The characteristic parameters generally include fineness (linear density), twist, blending ratio (color blending ratio), etc. The characteristic parameters are important features which should be controlled during a forming process.

The yarn can be divided into four categories:

(1) yarn with a constant linear density and a variable blending ratio, such as a color yarn of constant liner density, with a gradient or segmented color;

(2) yarn with a constant blending ratio and variable linear density, such as a slub yarn, a dotted yarn, etc.;

(3) yarn with a variable linear density and blending ratio, such as segmented a color slub yarn, a segmented color dotted yarn, etc.;

(4) blended yarn or mixed color yarn mixed at any rate, with a constant linear density and blending ratio.

The development of yarn processing technology mainly relates to the problems of special yarns. The existing spinning technology and the patent applications fail to guide the spinning production of the above four types of yarns, challenging the existing spinning theories. Specifically, it is analyzed as follows:

(1) Yarn with a Constant Linear Density and a Variable Blending Ratio (Color Blending Ratio)

The yarn with a constant linear density and a variable blending ratio (color blending ratio) can be assumed as a color yarn of constant liner density, with a gradient or segmented color. No existing patent application is related to this type of yarn.

(2) Yarn with a Constant Blending Ratio and Variable Linear Density

The yarn with a constant blending ratio and variable linear density, can be such as a slub yarn, a dotted yarn, etc. The existing method of manufacturing the ring spun yarn with a variable linear density comprises feeding one roving yarn each to the middle roller and back roller, and discontinuously spinning to manufacture the yarns with variable linear density by uneven feeding from the back roller. For example, a patent entitled "a discontinuous spinning process and yarns thereof" (ZL01126398.9), comprising: feeding an auxiliary fiber strand B from the back roller; unevenly drafting it via the middle roller and back roller; integrating with another main fiber strand A fed from the middle roller, and entering into the drafting area; drafting them by the front roller and middle roller, and outputting from the jaw of the front roller; entering into the twisting area to be twisted and form yarns. Because the auxiliary fiber strand is fed from the back roller intermittently and integrates with the main fiber strand, under the influence of the front area main drafting ratio, the main fiber strand is evenly drafted to a certain linear density, and the auxiliary fiber strand is attached to the main fiber strand to form a discontinuous and uneven linear density distribution. By controlling the fluctuation quantity of the uneven feeding from the back roller, different effects such as a dotted yarn, a slub yarn, etc. are obtained finally on the yarn. The deficiencies of this method are that the main and auxiliary fiber strands cannot be exchanged and a range of slub thickness is limited.

(3) Yarn with a Variable Linear Density and Blending Ratio

No existing patent application relates to this type of yarn.

(4) Blended Yarn or Mixed Color Yarn Mixed at any Rate, with a Constant Linear Density and Blending Ratio The blended yarn or mixed color yarn mixed at any rate, with a constant linear density and blending ratio, are disclosed. The current method comprises blending two or more than two different ingredients to obtain a roving yarn at a certain blending ratio, by fore-spinning process, then spinning the roving yarn to form a spun yarn by spinning process to obtain a yarn with a constant linear density and a blending ratio. Usually spinning processes can only achieve several conventional proportions, such as 50:50, 65:35, 60:40. The deficiencies are that they cannot be blended at any rate and two or more than two fibers cannot be blended at any rate in a single step.

SUMMARY OF THE INVENTION

To solve the above problems, the objective of this invention is to disclose a process of providing four-ingredient asynchronous/synchronous two-stage drafting fiber strands, and then integrating and twisting to form a yarn. The linear density and blending ratio of a ring spun yarn can be adjusted arbitrarily. The invention can adjust the linear density and blending ratio of the yarn at the same time to produce the above four types of yarns, overcoming the limitation of being unable to adjust characteristic parameters of a yarn on line.

To achieve the above objectives, the invention discloses a method of dynamically configuring linear density and blending ratio of yarn by four-ingredient asynchronous/synchronous drafting, comprising:

1) An actuating mechanism mainly includes a four-ingredient asynchronous/synchronous two-stage drafting mechanism, a twisting mechanism and a winding mechanism. The four-ingredient asynchronous/synchronous two-stage drafting mechanism includes a first stage asynchronous drafting unit and a successive second stage synchronous drafting unit;

2) The first stage asynchronous drafting unit includes a combination of back rollers and a middle roller. The combination of back rollers has four rotational degrees of freedom and includes a first back roller, a second back roller, a third back roller and a fourth back roller, which are set abreast on a same back roller shaft. The first back roller, the second back roller, the third back roller and the fourth back roller move at the speeds $V_{h1}$, $V_{h2}$, $V_{h3}$, $V_{h4}$ respectively. The middle roller rotates at the speed $V_z$. The second stage synchronous drafting unit includes a front roller and the middle roller. The front roller rotates at the surface linear speed $V_q$.

Assuming the linear densities of a first roving yarn ingredient, a second roving yarn ingredient, a third roving yarn ingredient, a fourth roving yarn ingredient drafted by the first back roller, the second back roller, the third back roller and the fourth back roller are respectively $\rho_1$, $\rho_2$, $\rho_3$, $\rho_4$, the linear density of the yarn Y drafted and twisted by the front roller is $\rho_y$.

$$\rho_y = \frac{1}{V_q}(V_{h1} * \rho_1 + V_{h2} * \rho_2 + V_{h3} * \rho_3 + V_{h4} * \rho_4) \tag{1}$$

The blending ratios of the first roving yarn ingredient, the second roving yarn ingredient, the third roving yarn ingredient, the fourth roving yarn ingredient are respectively $k_1$, $k_2$, $k_3$, $k_4$.

$$k_1 = \frac{\rho_1''}{\rho_1'' + \rho_2'' + \rho_3'' + \rho_4''} = \frac{\rho_1'}{\rho_1' + \rho_2' + \rho_3' + \rho_4'} = \frac{\rho_1 * V_{h1}}{\rho_1 + V_{h1} * \rho_2 + V_{h2} + \rho_3 * V_{h3} + \rho_4 * V_{h4}}$$

$$k_2 = \frac{\rho_2''}{\rho_1'' + \rho_2'' + \rho_3'' + \rho_4''} = \frac{\rho_2'}{\rho_1' + \rho_2' + \rho_3' + \rho_4'} = \frac{\rho_2 * V_{h2}}{\rho_1 + V_{h1} + \rho_2 * V_{h2} + \rho_3 * V_{h3} + \rho_4 * V_{h4}}$$

$$k_3 = \frac{\rho_3''}{\rho_1'' + \rho_2'' + \rho_3'' + \rho_4''} = \frac{\rho_3'}{\rho_1' + \rho_2' + \rho_3' + \rho_4'} = \frac{\rho_3 * V_{h3}}{\rho_1 + V_{h1} + \rho_2 * V_{h2} + \rho_3 * V_{h3} + + \rho_4 * V_{h4}}$$

$$k_4 = \frac{\rho_4''}{\rho_1'' + \rho_2'' + \rho_3'' + \rho_4''} = \frac{\rho_4'}{\rho_1' + \rho_2' + \rho_3' + \rho_4'} = \frac{\rho_4 * V_{h4}}{\rho_1 + V_{h1} + \rho_2 * V_{h2} + \rho_3 * V_{h3} + + \rho_4 * V_{h4}}$$

3) Keeping the ratio of linear speeds of the front roller and the middle roller $V_q/V_z$ constant, the speeds of the front roller and the middle roller depend on reference linear density of the yarn;

4) The linear density of yarn Y or/and blending ratio can be dynamically adjusted on line, by adjusting the rotation rates of the first back roller, the second back roller, the third back roller and the fourth back roller.

Further, according to the changes of the blending ratio K of the yarn Y with time t, and the changes of the linear density $\rho_y$ of the yarn Y with the time t, the changes of the surface linear speeds of the first back roller, the second back roller, the third back roller and the fourth back roller are derived. The blending ratios of the first roving yarn ingredient, the second roving yarn ingredient, the third roving yarn ingredient, the fourth roving yarn ingredient are set respectively as $k_1$, $k_2$, $k_3$, $k_4$. The ratios of blending ratios of the yarn Y are respectively $K_1$, $K_2$ and $K_3$, $$K_1 = \frac{k_1}{k_2} = \frac{\rho_1 V_{h1}}{\rho_2 V_{h2}}$$

-continued $$K_2 = \frac{k_1}{k_3} = \frac{\rho_1 V_{h1}}{\rho_3 V_{h3}}$$

$$K_3 = \frac{k_1}{k_4} = \frac{\rho_1 V_{h1}}{\rho_4 V_{h4}}$$

Linear density of yarn Y is $$\rho_y = \frac{V_{h1} * \rho_1 + V_{h2} * \rho_2 + V_{h3} * \rho_3 + V_{h4} * \rho_4}{V_q}$$

Then a surface linear speed of the back roller 1:

$$V_{h1} = \frac{\rho_y V_q}{\rho_1\left(1 + \frac{1}{K_1} + \frac{1}{K_2} + \frac{1}{K_3}\right)}$$

a surface linear speed of the back roller 2:

$$V_{h2} = \frac{\rho_y V_q}{\rho_2\left(1 + K_1 + \frac{K_1}{K_2} + \frac{K_1}{K_3}\right)}$$

a surface linear speed of the back roller 3:

$$V_{h3} = \frac{\rho_y V_q}{\rho_3\left(1 + K_2 + \frac{K_2}{K_1} + \frac{K_2}{K_2}\right)}$$

a surface linear speed of the back roller 4:

$$V_{h4} = \frac{\rho_y V_q}{\rho_4\left(1 + K_2 + \frac{K_2}{K_1} + \frac{K_2}{K_2}\right)}$$

wherein $\rho_1$, $\rho_2$, $\rho_3$, $\rho_4$ and $V_q$ are constants, and $K_i$ and $\rho_y$ are functions changing with time t.

Further, let $\rho_1=\rho_2=\rho_3=\rho_4=\rho$, then:

1) change the speed of any one of the first back roller, the second back roller, the third back roller, the fourth back roller, and keep the speeds of the other three backer rollers unchanged. The yarn ingredient and the linear density thereof of the yarn Y drafted by this back roller change accordingly. The linear density $\rho'_y$ of the yarn Y is adjusted as:

$$\rho'_y = \rho_y + \Delta\rho_y = \frac{\rho}{V_q} * (V_{h1} + V_{h2} + V_{h3} + V_{h4} + \Delta V_{h4})$$

or $$\rho'_y = \rho_y + \Delta\rho_y = \frac{\rho}{V_q} * (V_{h1} + V_{h2} + V_{h3} + V_{h4} + \Delta V_{h3})$$

or $$\rho'_y = \rho_y + \Delta\rho_y = \frac{\rho}{V_q} * (V_{h1} + V_{h2} + V_{h3} + V_{h4} + \Delta V_{h2})$$

-continued or $$\rho'_y = \rho_y + \Delta\rho_y = \frac{\rho}{V_q} * (V_{h1} + V_{h2} + V_{h3} + V_{h4} + \Delta V_{h1})$$

wherein $\Delta\rho_y$ is a linear density change of the yarn, $\Delta V_{h1}$, $\Delta V_{h2}$, $\Delta V_{h3}$ and $\Delta V_h$ is a speed change of the back roller one, second, third and fourth respectively.

2) change the speeds of any two back rollers of the first back roller, the second back roller, the third back roller, the fourth back roller, and keep the speeds of the other two backer rollers unchanged. The yarn ingredients of the yarn Y drafted by these any two back rollers and the linear densities thereof change accordingly. The linear density $\rho'_y$ of yarn Y is adjusted as:

$$\rho'_y = \rho_y + \Delta\rho_y = \frac{\rho}{V_q} * (V_{h1} + V_{h2} + V_{h3} + V_{h4} + (\Delta V_{h1} + \Delta V_{h2})]$$

or $$\rho'_y = \rho_y + \Delta\rho_y = \frac{\rho}{V_q} * [V_{h1} + V_{h2} + V_{h3} + V_{h4} + (\Delta V_{h1} + \Delta V_{h4})]$$

or $$\rho'_y = \rho_y + \Delta\rho_y = \frac{\rho}{V_q} * [V_{h1} + V_{h2} + V_{h3} + V_{h4} + (\Delta V_{h1} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h2} + \Delta V_{h4})]$$

or $$\rho'_y = \rho_y + \Delta\rho_y = \frac{\rho}{V_q} * (V_{h1} + V_{h2} + V_{h3} + V_{h4} + (\Delta V_{h3} + \Delta V_{h4})]$$

3) change the speeds of any three back rollers of the first back roller, the second back roller, the third back roller, the fourth back roller, and keep the speeds of the other one backer rollers unchanged. The yarn ingredients of the yarn Y drafted by these any three back rollers and the linear densities thereof change accordingly. The linear density $\rho'_y$ of the yarn Y is adjusted as:

$$\rho'_y = \rho_y + \Delta\rho_y = \frac{\rho}{V_q} * [V_{h1} + V_{h2} + V_{h3} + V_{h4} + (\Delta V_{h1} + \Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h4} + \Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h4} + \Delta V_{h1} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h4} + \Delta V_{h2} + \Delta V_{h1})]$$

4) change the speeds of the first back roller, the second back roller, the third back roller and the fourth back roller simultaneously, and the sum of the speeds of the four back rollers is unequal to zero. The yarn ingredients of the yarn Y drafted by these four back rollers and the linear densities thereof change accordingly. The linear density $\rho'_y$ of the yarn Y is adjusted as:

$$\rho'_y = \rho_y + \Delta\rho_y = \frac{\rho}{V_q} * [V_{h1} + V_{h2} + V_{h3} + V_{h4} + (\Delta V_{h1} + \Delta V_{h2} + \Delta V_{h3} + \Delta V_{h4})]$$

Further, change the speeds of the first back roller, the second back roller, the third back roller, the fourth back roller, and make the speed of any of back rollers equal to zero, while the speeds of the other three backer rollers unequal to zero. The yarn ingredient of the yarn Y drafted by the any one of back rollers is thus discontinuous, while the other three yarn ingredients are continuous. The linear density $\rho'_y$ of yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{h1} + \Delta V_{h1}) + (V_{h2} + \Delta V_{h2}) + (V_{h3} + \Delta V_{h3})](T_1 \le t \le T_2)$$

or $$\rho'_y = \frac{\rho}{V_q} * [(V_{h1} + \Delta V_{h1}) + (V_{h4} + \Delta V_{h4}) + (V_{h3} + \Delta V_{h3})](T_1 \le t \le T_2)$$

or $$\rho'_y = \frac{\rho}{V_q} * [(V_{h4} + \Delta V_{h4}) + (V_{h2} + \Delta V_{h2}) + (V_{h3} + \Delta V_{h3})](T_1 \le t \le T_2)$$

or $$\rho'_y = \frac{\rho}{V_q} * [(V_{h1} + \Delta V_{h1}) + (V_{h2} + \Delta V_{h2}) + (V_{h4} + \Delta V_{h4})](T_1 \le t \le T_2)$$

wherein $T_1$, and $T_2$ are time points, and t is a time variable.

Further, change the speeds of the first back roller, the second back roller, the third back roller, the fourth back roller, and make the speeds of any two back rollers equal to zero, while the speeds of the other three backer rollers unequal to zero. The yarn ingredients of the yarn Y drafted by the any two back rollers are thus discontinuous, while the other two yarn ingredients are continuous. The linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hi} + \Delta V_{hi}) + (V_{hj} + \Delta V_{hj})](T_1 \le t \le T_2)$$

wherein $T_1$, and $T_2$ are time points, and t is a time variable, $i,j \in (1,2,3,4)$.

Further, change the speeds of the first back roller, the second back roller, the third back roller, the fourth back roller, and make the speeds of any three back rollers equal to zero, while the speeds of the other one backer rollers unequal to zero. The yarn ingredients of the yarn Y drafted by the any three back rollers are thus discontinuous, while the other one yarn ingredients are continuous. The linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{kj} + \Delta V_{hj})](T_1 \le t \le T_2)$$

wherein $T_1$, and $T_2$ are time points, and t is a time variable; j∈(1,2,3,4).

Further, change the speeds of the first back roller, the second back roller, the third back roller, the fourth back roller, and make the speeds of any two back rollers equal to zero successively, while the speeds of the other two backer rollers unequal to zero. The yarn ingredients of the yarn Y drafted by the any two back rollers are thus discontinuous successively, while the other two yarn ingredients are continuous. The linear density $\rho'_y$ of yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{ki} + \Delta V_{hi})(V_{hj} + \Delta V_{hj})(V_{hk} + \Delta V_{hk})](T_1 \le t \le T_2)$$

$$\rho'_y = \frac{\rho}{V_q} * [(V_{hi} + \Delta V_{hj}) + (V_{hj} + \Delta V_{hj})](T_2 \le t \le T_3)$$

wherein $T_1$, $T_2$ and $T_3$ are time points, and t is a time variable. i≠j≠k and i,j,k∈(1,2,3,4).

Further, change the speeds of the first back roller, the second back roller, the third back roller and the fourth back roller, and make the speeds of any three back rollers equal to zero successively, while the speeds of the other one backer rollers unequal to zero. The yarn ingredients of the yarn Y drafted by the any three back rollers are thus discontinuous successively, while the other yarn ingredients are continuous. The linear density $\rho'_y$ of yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hi} + \Delta V_{hi}) + (V_{hj} + \Delta V_{hj}) + (V_{hk} + \Delta V_{hk})](T_1 \le t \le T_2)$$

$$\rho'_y = \frac{\rho}{V_q} * [(V_{hi} + \Delta V_{hi}) + (V_{hj} + \Delta V_{hj})](T_2 \le t \le T_3)$$

$$\rho'_y = \frac{\rho}{V_q} * [(V_{hi} + \Delta V_{hi})](T_3 \le t \le T_4)$$

wherein $T_1$, $T_2$ $T_3$ and $T_4$ are time points, and t is a time variable. i≠j≠k and i,j,k∈(1,2,3,4).

Further, change the speeds of the first back roller, the second back roller, the third back roller and the fourth back roller and keep $$V_{h1}*\rho_1+V_{h2}*\rho_2+V_{h3}*\rho_3+V_{h4}*\rho_4=\text{constant}$$

and let $\rho_1=\rho_2=\rho_3=\rho_4=\rho$, then the linear density of the yarn Y is thus fixed while the blending ratios of the ingredients thereof change; the blending ratios of the first roving ingredient, the second roving ingredient, the third roving ingredient, the fourth roving ingredient are $k_1$, $k_2$, $k_3$, $k_4$.

$$k_j = \frac{V_{hj} + \Delta V_{hj}}{V_{h1} + \Delta V_{h1} + V_{h2} + \Delta V_{h2} + V_{h3} + \Delta V_{h3} + V_{h4} + \Delta V_{h4}}$$

wherein j∈(1,2,3,4).

Further, according to the set blending ratio and/or linear density, divide the yarn Y into n segments. The linear density and blending ratio of each segment of the yarn Y are the same, while the linear densities and blending ratios of the adjacent segments are different. When drafting the segment i of the yarn Y, the linear speeds of the first back roller, the second back roller, the third back roller and the fourth back roller are $V_{h1i}$, $V_{h2i}$, $V_{h3i}$, $V_{h4i}$, wherein i∈(1, 2, . . . , n) The first roving ingredient, the second roving ingredient, the third roving ingredient, the fourth roving ingredient are two-stage drafted and twisted to form segment i of the yarn Y, and the blending ratios $k_{1i}$, $k_{2i}$, $k_{3i}$, $k_{4i}$ thereof are expressed as below:

$$k_{1i} = \frac{\rho_1 * V_{h1i}}{\rho_1 * V_{h1i} + \rho_2 * V_{h2i} + \rho_3 * V_{h3i} + \rho_4 * V_{h4i}} \quad (2)$$

$$k_{2i} = \frac{\rho_2 * V_{h21}}{\rho_1 * V_{h1i} + \rho_2 * V_{h2i} + \rho_3 * V_{h3i} + \rho_4 * V_{h4i}} \quad (3)$$

$$k_{3i} = \frac{\rho_3 * V_{h3i}}{\rho_1 * V_{h1i} + \rho_2 * V_{h2i} + \rho_3 * V_{h3i} + \rho_4 * V_{h4i}} \quad (4)$$

$$k_{4i} = \frac{\rho_4 * V_{h4i}}{\rho_1 * V_{h1i} + \rho_2 * V_{h2i} + \rho_3 * V_{h3i} + \rho_4 * V_{h4i}} \quad (5)$$

the linear density of segment i of yarn Y is:

$$\rho_{yi} = \frac{V_z}{V_q} * \left(\frac{V_{h11}}{V_z} * \rho_1 + \frac{V_{h21}}{V_z} * \rho_2 + \frac{V_{h31}}{V_z} * \rho_3 + \frac{V_{h41}}{V_z} * \rho_4\right) = \frac{1}{e_q} * \left(\frac{V_{h11}}{V_z} * \rho_1 + \frac{V_{h21}}{V_z}\rho_2 + \frac{V_{h31}}{V_z}\rho_3 + \frac{V_{h41}}{V_z}\rho_4\right) \quad (6)$$

wherein $$e_q = \frac{V_q}{V_z}$$

is the two-stage drafting ratio;

(1) Take the segment with the lowest density as a reference segment, whose reference linear density is $\rho_0$. The reference linear speeds of the first back roller, the second back roller, the third back roller and the fourth back roller for this segment are respectively $V_{h10}$, $V_{h20}$, $V_{h30}$, $V_{h40}$; and the reference blending ratios of the first roving yarn ingredient, the second roving yarn ingredient, the third roving yarn ingredient, the fourth roving yarn ingredient for this segment are respectively $k_{10}$, $k_{20}$, $k_{30}$, $k_{40}$, Keep the linear speed of the middle roller constant, and $$V_z=V_{h10}+V_{h20}+V_{h30}+V_{h40} \quad (7);$$

also keep two-stage drafting ratio $$e_q = \frac{V_q}{V_z}$$

constant;

wherein the reference linear speeds of the first back roller, the second back roller, the third back roller and the fourth back roller for this segment are respectively $V_{h10}$, $V_{h20}$, $V_{h30}$, $V_{h40}$ and $V_{h50}$, which can be predetermined according to the material, reference linear density $\rho_0$ and reference blending ratios $k_{10}$, $k_{20}$, $k_{30}$, $k_{40}$ of the first roving ingredient, the second roving ingredient, the third roving ingredient, the fourth roving ingredient.

(2) When the segment i of the yarn Y is drafted and blended, on the premise of known set linear density $\rho_{yi}$ and blending ratios $k_{1i}$, $k_{2i}$, $k_{3i}$, $k_{4i}$, the linear speeds $V_{h1i}$, $V_{h2i}$, $V_{h3i}$, $V_{h4i}$ of the first back roller, the second back roller, the third back roller and the fourth back roller are calculated according to Equations (2)-(7);

(3) Based on the reference linear speeds $V_{h10}$, $V_{h20}$, $V_{h30}$, $V_{h40}$ for the reference segment, increase or decrease the rotation rates of the first back roller, the second back roller, the third back roller, or/and the fourth back roller to dynamically adjust the linear density or/and blending ratio for the segment i of the yarn Y.

Further, let $\rho_1=\rho_2=\rho_3=\rho_4=\beta$, the Equation (6) can be simplified as $$\rho_{yi} = \frac{\rho}{e_q} * \frac{V_{h1i} + V_{h2i} + V_{h3i} + V_{h4i}}{V_z} \tag{8}$$

According to Equations(2)-(5) and (7)-(8), the linear speeds $V_{h1i}$, $V_{h2i}$, $V_{h3i}$, $V_{h4i}$ of the first back roller, the second back roller, the third back roller and the fourth back roller are calculated; based on the reference linear speeds $V_{h10}$, $V_{h20}$, $V_{h30}$, $V_{h40}$, the rotation rates of the first back roller, the second back roller, the third back roller, or/and the fourth back roller are increased or decreased to reach the preset linear density and blending ratio for the segment i of yarn Y.

Further, at the moment of switching the segment i−1 to the segment i of yarn Y, let the linear density of the yarn Y increase by dynamic increment $\Delta\rho_{yi}$, i.e., thickness change $\Delta\rho_{yi}$, on the basis of reference linear density; and thus the first back roller, the second back roller, the third back roller, and the fourth back roller have corresponding increments on the basis of the reference linear speed, i.e., when $(V_{h10}+V_{h20}+V_{h30}+V_{h40})\rightarrow(V_{h10}+\Delta V_{h1i}+V_{h20}+\Delta V_{h2i}+V_{h30}+\Delta V_{h3i}+V_{h40}+\Delta V_{h4i})$, the linear density increment of yarn Y is:

$$\Delta\rho_{yi} = \frac{\rho}{e_q * V_z} * (\Delta V_{h1i} + \Delta V_{h2i} + \Delta V_{h3i} + \Delta V_{h4i});$$

Then the linear density $\rho_{yi}$ of the yarn Y is expressed as $$\rho_{yi} = \rho_{y0} + \Delta\rho_{yi} = \rho_{y0} + \frac{\Delta V_{h1i} + \Delta V_{h2i} + \Delta V_{h3i} + \Delta V_{h4i}}{V_z} * \frac{\rho}{e_q} \tag{9}$$

Let $\Delta V_i=\Delta V_{h1i}+\Delta V_{h2i}+\Delta V_{h3i}+\Delta V_{h4i}$, then Equation (9) is simplified as:

$$\rho_{yi} = \rho_{y0} + \frac{\Delta V_i}{V_z} * \frac{\rho}{e_q} \tag{10}$$

The linear density of yarn Y can be adjusted by controlling the sum of the linear speed increments $\Delta V_i$ of the first back roller, the second back roller, the third back roller, and the fourth back roller.

Further, let $\rho_1=\rho_2=\rho_3=\rho_4=\rho$, at the moment of switching the segment i−1 to the segment i of the yarn Y, the blending ratios of the yarn Y in Equations (2)-(5) can be simplified as:

$$k_{1i} = \frac{V_{h10} + \Delta V_{h1i}}{V_z + \Delta V_i} \tag{11}$$

$$k_{2i} = \frac{V_{h20} + \Delta V_{h2i}}{V_z + \Delta V_i} \tag{12}$$

$$k_{3i} = \frac{V_{h30} + \Delta V_{h3i}}{V_z + \Delta V_i} \tag{13}$$

$$k_{4i} = \frac{V_{h40} + \Delta V_{h4i}}{V_z + \Delta V_i} \tag{14}$$

The blending ratios of the yarn Y can be adjusted by controlling the linear speed increments of the first back roller, the second back roller, the third back roller, and the fourth back roller;

wherein $$\Delta V_{h1i}=k_{1i}*(V_Z+\Delta V_i)-V_{h10}$$

$$\Delta V_{h2i}=k_{2i}*(V_Z+\Delta V_i)<V_{h20}$$

$$\Delta V_{h3i}=k_{3i}*(V_Z+\Delta V_i)-V_{h30}$$

$$\Delta V_{h4i}=k_{4i}*(V_Z+\Delta V_i)-V_{h40}$$

Further, let $V_{h1i}*\rho_1+V_{h2i}*\rho_2+V_{h3i}*\rho_3+V_{h4i}*\rho_4=H$, and H is a constant, then $\Delta V_i$ is constantly equal to zero, and thus the linear density is unchanged when the blending ratios of the yarn Y are adjusted.

Further, let any one to three of $\Delta V_{h1i}$, $\Delta V_{h2i}$, $\Delta V_{h3i}$, and $\Delta V_{h4i}$ be equal to zero, while the remaining ones are not zero, then the one to three roving yarn ingredients can be changed while the other roving yarn ingredients are unchanged. The adjusted blending ratio are:

$$k_{ki} = \frac{V_{hk0} + \Delta V_{hki}}{V_z + \Delta V_i}$$

$$k_{ji} = \frac{V_{hj0}}{V_z + \Delta V_i}$$

wherein k, j∈(1,2,3,4) and k≠j.

Further, let none of $\Delta V_{h1i}$, $\Delta V_{h2i}$, $\Delta V_{h3i}$, $\Delta V_{h4i}$ be equal to zero, then the proportion of the four roving yarn ingredients in the yarn Y may be changed.

Further, let any one to three of $\Delta V_{h1i}$, $\Delta V_{h2i}$, $\Delta V_{h3i}$, and $\Delta V_{h4i}$ be equal to zero, while the remaining ones are not zero, then the one to three roving yarn ingredients of the segment i of the yarn Y may be discontinuous.

Further, yellow, magenta, cyan, and black yarns are respectively drafted by the first back roller, the second back roller, the third back roller and the fourth back roller. The speed $V_q$ of the front roller is kept constant and the speeds of the first back roller, the second back roller, the third back roller and the fourth back roller are adjusted to regulate the colors of the yarns. When blending the colors, the color depth or the saturation of the colored spun yarn is adjusted by the black yarn.

In mixing mode of the four primary colors, taking 10 percent as changing rate, the following color mixing colors can be formed.

TABLE 1

Color scheme of different blending ratio

| | | Color A Ratio $K_1$ | Color B Ratio $K_2$ | Color C Ratio $K_3$ | Color D Ratio $K_4$ | No. |
|---|---|---|---|---|---|---|
| Single Color | A | 1 | 0 | 0 | 0 | 1 |
| | B | 0 | 1 | 0 | 0 | 2 |
| | C | 0 | 0 | 1 | 0 | 3 |
| | D | 0 | 0 | 0 | 1 | 4 |
| Blended By Double Colors | AB | 0.1 | 0.9 | 0 | 0 | 5 |
| | | 0.2 | 0.8 | 0 | 0 | 6 |
| | | 0.3 | 0.7 | 0 | 0 | 7 |
| | | 0.4 | 0.6 | 0 | 0 | 8 |
| | | 0.5 | 0.5 | 0 | 0 | 9 |
| | | 0.6 | 0.4 | 0 | 0 | 10 |
| | | 0.7 | 0.3 | 0 | 0 | 11 |
| | | 0.8 | 0.2 | 0 | 0 | 12 |
| | | 0.9 | 0.1 | 0 | 0 | 13 |
| | AC | 0.1 | 0 | 0.9 | 0 | 14 |
| | | 0.2 | 0 | 0.8 | 0 | 15 |
| | | 0.3 | 0 | 0.7 | 0 | 16 |
| | | 0.4 | 0 | 0.6 | 0 | 17 |
| | | 0.5 | 0 | 0.5 | 0 | 18 |
| | | 0.6 | 0 | 0.4 | 0 | 19 |
| | | 0.7 | 0 | 0.3 | 0 | 20 |
| | | 0.8 | 0 | 0.2 | 0 | 21 |
| | | 0.9 | 0 | 0.1 | 0 | 22 |
| | AD | 0.1 | 0 | 0 | 0.9 | 23 |
| | | 0.2 | 0 | 0 | 0.8 | 24 |
| | | 0.3 | 0 | 0 | 0.7 | 25 |
| | | 0.4 | 0 | 0 | 0.6 | 26 |
| | | 0.5 | 0 | 0 | 0.5 | 27 |
| | | 0.6 | 0 | 0 | 0.4 | 28 |
| | | 0.7 | 0 | 0 | 0.3 | 29 |
| | | 0.8 | 0 | 0 | 0.2 | 30 |
| | | 0.9 | 0 | 0 | 0.1 | 31 |
| | BC | 0 | 0.1 | 0.9 | 0 | 32 |
| | | 0 | 0.2 | 0.8 | 0 | 33 |
| | | 0 | 0.3 | 0.7 | 0 | 34 |
| | | 0 | 0.4 | 0.6 | 0 | 35 |
| | | 0 | 0.5 | 0.5 | 0 | 36 |
| | | 0 | 0.6 | 0.4 | 0 | 37 |
| | | 0 | 0.7 | 0.3 | 0 | 38 |
| | | 0 | 0.8 | 0.2 | 0 | 39 |
| | | 0 | 0.9 | 0.1 | 0 | 40 |
| | BD | 0 | 0.1 | 0 | 0.9 | 41 |
| | | 0 | 0.2 | 0 | 0.8 | 42 |
| | | 0 | 0.3 | 0 | 0.7 | 43 |
| | | 0 | 0.4 | 0 | 0.6 | 44 |
| | | 0 | 8.5 | 0 | 0.5 | 45 |
| | | 0 | 0.6 | 0 | 8.4 | 46 |
| | | 0 | 0.7 | 0 | 0.3 | 47 |
| | | 0 | 0.8 | 0 | 0.2 | 48 |
| | | 0 | 0.9 | 0 | 0.1 | 49 |
| | CD | 0 | 0 | 0.1 | 0.9 | 50 |
| | | 0 | 0 | 0.2 | 0.8 | 51 |
| | | 0 | 0 | 0.3 | 0.7 | 52 |
| | | 0 | 0 | 0.4 | 0.6 | 53 |
| | | 0 | 0 | 0.5 | 0.5 | 54 |
| | | 0 | 0 | 0.6 | 0.4 | 55 |
| | | 0 | 0 | 0.7 | 0.3 | 56 |
| | | 0 | 0 | 0.8 | 0.2 | 57 |
| | | 0 | 0 | 0.9 | 0.1 | 58 |
| Blended By Three Colors | ABC | 0.1 | 0.1 | 0.8 | 0 | 59 |
| | | 0.1 | 0.2 | 0.7 | 0 | 60 |
| | | 0.1 | 0.3 | 0.6 | 0 | 61 |
| | | 0.1 | 0.4 | 0.5 | 0 | 62 |
| | | 0.1 | 0.5 | 0.4 | 0 | 63 |
| | | 0.1 | 0.6 | 0.3 | 0 | 64 |
| | | 0.1 | 0.7 | 0.2 | 0 | 65 |
| | | 0.1 | 0.8 | 0.1 | 0 | 66 |
| | | 0.2 | 0.1 | 0.7 | 0 | 67 |
| | | 0.2 | 0.2 | 0.6 | 0 | 68 |
| | | 0.2 | 0.3 | 0.5 | 0 | 69 |
| | | 0.2 | 0.4 | 0.4 | 0 | 70 |

TABLE 1-continued

Color scheme of different blending ratio

| | | Color A Ratio $K_1$ | Color B Ratio $K_2$ | Color C Ratio $K_3$ | Color D Ratio $K_4$ | No. |
|---|---|---|---|---|---|---|
| | | 0.2 | 0.5 | 0.3 | 0 | 71 |
| | | 0.2 | 0.6 | 0.2 | 0 | 72 |
| | | 0.2 | 0.7 | 0.1 | 0 | 73 |
| | | 0.3 | 0.1 | 0.6 | 0 | 74 |
| | | 0.3 | 0.2 | 0.5 | 0 | 75 |
| | | 0.3 | 0.3 | 0.4 | 0 | 76 |
| | | 0.3 | 0.4 | 0.3 | 0 | 77 |
| | | 0.3 | 0.5 | 0.2 | 0 | 78 |
| | | 0.3 | 0.6 | 0.1 | 0 | 79 |
| | | 0.4 | 0.1 | 0.5 | 0 | 80 |
| | | 0.4 | 0.2 | 0.4 | 0 | 81 |
| | | 0.4 | 0.3 | 0.3 | 0 | 82 |
| | | 0.4 | 0.4 | 0.2 | 0 | 83 |
| | | 0.4 | 0.5 | 0.1 | 0 | 84 |
| | | 0.5 | 0.1 | 0.4 | 0 | 85 |
| | | 0.5 | 0.2 | 0.3 | 0 | 86 |
| | | 0.5 | 0.3 | 0.2 | 0 | 87 |
| | | 0.5 | 0.4 | 0.1 | 0 | 88 |
| | | 0.6 | 0.1 | 0.3 | 0 | 89 |
| | | 0.6 | 0.2 | 0.2 | 0 | 90 |
| | | 0.6 | 0.3 | 0.1 | 0 | 91 |
| | | 0.7 | 0.1 | 0.2 | 0 | 92 |
| | | 0.7 | 0.2 | 0.1 | 0 | 93 |
| | | 0.8 | 0.1 | 0.1 | 0 | 94 |
| | BCD | 0 | 0.1 | 0.1 | 0.8 | 95 |
| | | 0 | 0.1 | 0.2 | 0.7 | 96 |
| | | 0 | 0.1 | 0.3 | 0.6 | 97 |
| | | 0 | 0.1 | 0.4 | 0.5 | 98 |
| | | 0 | 0.1 | 0.5 | 0.4 | 99 |
| | | 0 | 0.1 | 0.6 | 0.3 | 100 |
| | | 0 | 0.1 | 0.7 | 0.2 | 101 |
| | | 0 | 0.1 | 0.8 | 0.1 | 102 |
| | | 0 | 0.2 | 0.1 | 0.7 | 103 |
| | | 0 | 0.2 | 0.2 | 0.6 | 104 |
| | | 0 | 0.2 | 0.3 | 0.5 | 105 |
| | | 0 | 0.2 | 0.4 | 0.4 | 106 |
| | | 0 | 0.2 | 0.5 | 0.3 | 107 |
| | | 0 | 0.2 | 0.6 | 0.2 | 108 |
| | | 0 | 0.2 | 0.7 | 0.1 | 109 |
| | | 0 | 0.3 | 0.1 | 0.6 | 110 |
| | | 0 | 0.3 | 0.2 | 0.5 | 111 |
| | | 0 | 0.3 | 0.3 | 0.4 | 112 |
| | | 0 | 0.3 | 0.4 | 0.3 | 113 |
| | | 0 | 0.3 | 0.5 | 0.2 | 114 |
| | | 0 | 0.3 | 0.6 | 0.1 | 115 |
| | | 0 | 0.4 | 0.1 | 0.5 | 116 |
| | | 0 | 0.4 | 0.2 | 0.4 | 117 |
| | | 0 | 0.4 | 0.3 | 0.3 | 118 |
| | | 0 | 0.4 | 0.4 | 0.2 | 119 |
| | | 0 | 0.4 | 0.5 | 0.1 | 120 |
| | | 0 | 0.5 | 0.1 | 0.4 | 121 |
| | | 0 | 0.5 | 0.2 | 0.3 | 122 |
| | | 0 | 0.5 | 0.3 | 0.2 | 123 |
| | | 0 | 0.5 | 0.4 | 0.1 | 124 |
| | | 0 | 0.6 | 0.1 | 0.3 | 125 |
| | | 0 | 0.6 | 0.2 | 0.2 | 126 |
| | | 0 | 0.6 | 0.3 | 0.1 | 127 |
| | | 0 | 0.7 | 0.1 | 0.2 | 128 |
| | | 0 | 0.7 | 0.2 | 0.1 | 129 |
| | | 0 | 0.8 | 0.1 | 0.1 | 130 |
| | CDA | 0.8 | 0 | 0.1 | 0.1 | 131 |
| | | 0.7 | 0 | 0.1 | 0.2 | 132 |
| | | 0.6 | 0 | 0.1 | 0.3 | 133 |
| | | 0.5 | 0 | 0.1 | 0.4 | 134 |
| | | 0.4 | 0 | 0.1 | 0.5 | 135 |
| | | 0.3 | 0 | 0.1 | 0.6 | 136 |
| | | 0.2 | 0 | 0.1 | 0.7 | 137 |
| | | 0.1 | 0 | 0.1 | 0.8 | 138 |
| | | 0.7 | 0 | 0.2 | 0.1 | 139 |
| | | 0.6 | 0 | 0.2 | 0.2 | 140 |
| | | 0.5 | 0 | 0.2 | 0.3 | 141 |
| | | 0.4 | 0 | 0.2 | 0.4 | 142 |
| | | 0.3 | 0 | 0.2 | 0.5 | 143 |
| | | 0.2 | 0 | 0.2 | 0.6 | 144 |
| | | 0.1 | 0 | 0.2 | 0.7 | 145 |

TABLE 1-continued

| Color scheme of different blending ratio | | | | | | |
|---|---|---|---|---|---|---|
| | | Color A Ratio $K_1$ | Color B Ratio $K_2$ | Color C Ratio $K_3$ | Color D Ratio $K_4$ | No. |
| | | 0.6 | 0 | 0.3 | 0.1 | 146 |
| | | 0.5 | 0 | 0.3 | 0.2 | 157 |
| | | 0.4 | 0 | 0.3 | 0.3 | 148 |
| | | 0.3 | 0 | 0.3 | 0.4 | 149 |
| | | 0.2 | 0 | 0.3 | 0.5 | 150 |
| | | 0.1 | 0 | 0.3 | 0.6 | 151 |
| | | 0.5 | 0 | 0.4 | 0.1 | 152 |
| | | 0.4 | 0 | 0.4 | 0.2 | 153 |
| | | 0.3 | 0 | 0.4 | 0.3 | 154 |
| | | 0.2 | 0 | 0.4 | 0.4 | 155 |
| | | 0.1 | 0 | 0.4 | 0.5 | 156 |
| | | 0.4 | 0 | 0.5 | 0.1 | 157 |
| | | 0.3 | 0 | 0.5 | 0.2 | 158 |
| | | 0.2 | 0 | 0.5 | 0.3 | 159 |
| | | 0.1 | 0 | 0.5 | 0.4 | 160 |
| | | 0.3 | 0 | 0.6 | 0.1 | 161 |
| | | 0.2 | 0 | 0.6 | 0.2 | 162 |
| | | 0.1 | 0 | 0.6 | 0.3 | 163 |
| | | 0.2 | 0 | 0.7 | 0.1 | 164 |
| | | 0.1 | 0 | 0.7 | 0.2 | 165 |
| | | 0.1 | 0 | 0.8 | 0.1 | 166 |
| Blended By Four Colors | ABCD | 0.1 | 0.1 | 0.1 | 0.7 | 167 |
| | | 0.1 | 0.1 | 0.2 | 0.6 | 168 |
| | | 0.1 | 0.1 | 0.3 | 0.5 | 169 |
| | | 0.1 | 0.1 | 0.4 | 0.4 | 170 |
| | | 0.1 | 0.1 | 0.5 | 0.3 | 171 |
| | | 0.1 | 0.1 | 0.6 | 0.2 | 172 |
| | | 0.1 | 0.1 | 0.7 | 0.1 | 173 |
| | | 0.1 | 0.1 | 0.7 | 0.1 | 174 |
| | | 0.1 | 0.2 | 0.6 | 0.1 | 175 |
| | | 0.1 | 0.3 | 0.5 | 0.1 | 176 |
| | | 0.1 | 0.4 | 0.4 | 0.1 | 177 |
| | | 0.1 | 0.5 | 0.3 | 0.1 | 178 |
| | | 0.1 | 0.6 | 0.2 | 0.1 | 179 |
| | | 0.1 | 0.7 | 0.1 | 0.1 | 180 |
| | | 0.1 | 0.7 | 0.1 | 0.1 | 181 |
| | | 0.1 | 0.6 | 0.1 | 0.2 | 182 |
| | | 0.1 | 0.5 | 0.1 | 0.3 | 183 |
| | | 0.1 | 0.4 | 0.1 | 0.4 | 184 |
| | | 0.1 | 0.3 | 0.1 | 0.5 | 185 |
| | | 0.1 | 0.2 | 0.1 | 0.6 | 186 |
| | | 0.1 | 0.1 | 0.1 | 0.7 | 187 |
| | | 0.2 | 0.1 | 0.1 | 0.6 | 188 |
| | | 0.2 | 0.1 | 0.2 | 0.5 | 189 |
| | | 0.2 | 0.1 | 0.3 | 0.4 | 190 |
| | | 0.2 | 0.1 | 0.4 | 0.3 | 191 |
| | | 0.2 | 0.1 | 0.5 | 0.2 | 192 |
| | | 0.2 | 0.1 | 0.6 | 0.1 | 193 |
| | | 0.2 | 0.1 | 0.6 | 0.1 | 194 |
| | | 0.2 | 0.2 | 0.5 | 0.1 | 195 |
| | | 0.2 | 0.3 | 0.4 | 0.1 | 196 |
| | | 0.2 | 0.4 | 0.3 | 0.1 | 197 |
| | | 0.2 | 0.5 | 0.2 | 0.1 | 198 |
| | | 0.2 | 0.6 | 0.1 | 0.1 | 199 |
| | | 0.2 | 0.6 | 0.1 | 0.1 | 200 |
| | | 0.2 | 0.5 | 0.1 | 0.2 | 201 |
| | | 0.2 | 0.4 | 0.1 | 0.3 | 202 |
| | | 0.2 | 0.3 | 0.1 | 0.4 | 203 |
| | | 0.2 | 0.2 | 0.1 | 0.5 | 204 |
| | | 0.2 | 0.1 | 0.1 | 0.6 | 205 |
| | | 0.3 | 0.1 | 0.1 | 0.5 | 206 |
| | | 0.3 | 0.1 | 0.2 | 0.4 | 207 |
| | | 0.3 | 0.1 | 0.3 | 0.3 | 208 |
| | | 0.3 | 0.1 | 0.4 | 0.2 | 209 |
| | | 0.3 | 0.1 | 0.5 | 0.1 | 210 |
| | | 0.3 | 0.1 | 0.5 | 0.1 | 211 |
| | | 0.3 | 0.2 | 0.4 | 0.1 | 212 |
| | | 0.3 | 0.3 | 0.3 | 0.1 | 213 |
| | | 0.3 | 0.4 | 0.2 | 0.1 | 214 |
| | | 0.3 | 0.5 | 0.1 | 0.1 | 215 |
| | | 0.3 | 0.5 | 0.1 | 0.1 | 216 |
| | | 0.3 | 0.4 | 0.1 | 0.2 | 217 |
| | | 0.3 | 0.3 | 0.1 | 0.3 | 218 |
| | | 0.3 | 0.2 | 0.1 | 0.4 | 219 |
| | | 0.3 | 0.1 | 0.1 | 0.5 | 220 |

TABLE 1-continued

| Color scheme of different blending ratio | | | | |
|---|---|---|---|---|
| Color A Ratio $K_1$ | Color B Ratio $K_2$ | Color C Ratio $K_3$ | Color D Ratio $K_4$ | No. |
| 0.4 | 0.1 | 0.1 | 0.4 | 221 |
| 0.4 | 0.1 | 0.2 | 0.3 | 222 |
| 0.4 | 0.1 | 0.3 | 0.2 | 223 |
| 0.4 | 0.1 | 0.4 | 0.1 | 224 |
| 0.4 | 0.1 | 0.4 | 0.1 | 225 |
| 0.4 | 0.2 | 0.3 | 0.1 | 226 |
| 0.4 | 0.3 | 0.2 | 0.1 | 227 |
| 0.4 | 0.4 | 0.1 | 0.1 | 228 |
| 0.4 | 0.4 | 0.1 | 0.1 | 229 |
| 0.4 | 0.3 | 0.1 | 0.2 | 230 |
| 0.4 | 0.2 | 0.1 | 0.3 | 231 |
| 0.4 | 0.1 | 0.1 | 0.4 | 232 |
| 0.5 | 0.1 | 0.1 | 0.3 | 233 |
| 0.5 | 0.1 | 0.2 | 0.2 | 234 |
| 0.5 | 0.1 | 0.3 | 0.1 | 235 |
| 0.5 | 0.1 | 0.3 | 0.1 | 236 |
| 0.5 | 0.2 | 0.2 | 0.1 | 237 |
| 0.5 | 0.3 | 0.1 | 0.1 | 238 |
| 0.5 | 0.3 | 0.1 | 0.1 | 239 |
| 0.5 | 0.2 | 0.1 | 0.2 | 240 |
| 0.5 | 0.1 | 0.1 | 0.3 | 241 |
| 0.6 | 0.1 | 0.1 | 0.2 | 242 |
| 0.6 | 0.1 | 0.2 | 0.1 | 243 |
| 0.6 | 0.1 | 0.2 | 0.1 | 244 |
| 0.6 | 0.2 | 0.1 | 0.1 | 245 |
| 0.6 | 0.2 | 0.1 | 0.1 | 246 |
| 0.6 | 0.1 | 0.1 | 0.2 | 247 |
| 0.7 | 0.1 | 0.1 | 0.1 | 248 |

There can be countless combinations with CMYK four basic colored slivers (Magenta, Yellow, Cyan and Black) different blend ratio under the condition that $K_1+K_2+K_3+K_4=100\%$. By coupling and drafting, interactive discolour, gradient color matching, and blending and twisting from the ring spinning frame-drafting-twisting system, the yellow, magenta, cyan, and black fibers of the yellow, magenta, cyan, and black roving yarns, i.e., CMYK four basic colors roving yarns can be blended in any proportion considering. Taking 10 percent as changing rate, there are 248 different colored yarns can be produced. Color blending types were greatly enriched. Yellow, magenta, cyan three kinds of color yarn cannot bring about color effects in theory during the process of blending, due to the characteristics of the material itself and engineering defects of the production process, resulting color difference between the theoretical and the present. Through the introduction of black color in this invention, using black yarn to adjust the final yarn color depth, and to make up for these deficiencies, the desired color effect can be get.

A device for configuring a linear density and a blending ratio of a yarn by four-ingredient asynchronous/synchronous drafted, comprises a control system and an actuating mechanism. The actuating mechanism includes four-ingredient asynchronous/synchronous two-stage drafting mechanism, a twisting mechanism and a winding mechanism. The two-stage drafting mechanism includes a first stage drafting unit and a second stage drafting unit; the first stage drafting unit includes a combination of back rollers and a middle roller. The combination of back rollers has four rotational degrees of freedom and includes a first back roller, a second back roller, a third back roller, a fourth back roller, which are set abreast on a same back roller shaft. The second stage drafting unit includes a front roller and the middle roller.

Further, the control system mainly includes a PLC programmable controller, a servo driver, a servo motor, etc.

Further, any of the back roller including the first back roller, second back roller, third back roller and fourth back roller disposed on a fixed shaft, the other three back rollers disposed independently of each other in the back roller axis.

Further, the third back roller is fixedly set on the back roller shaft. The other three back rollers are respectively symmetrically set on the back roller shaft and independently rotatable with each other. The second back roller has a second sleeve connected to the driving mechanism thereof; the second sleeve is placed around the back roller shaft, and the first back roller is rotatably placed around the second sleeve.

Further, during the process of drafting, the speed of the middle roller is fixed and no more than the sum of the speeds of the first back roller, the second back roller, the third back roller, and the fourth back roller.

The method of the invention changes the traditional four-ingredient front and back areas synchronous drafting to four-ingredient separate asynchronous drafting (referred to as first stage asynchronous drafting) and four-ingredient integrated synchronous drafting (referred to as second stage synchronous drafting). The blending proportion of the four ingredients and linear density of the yarn are dynamically adjusted by the first stage separate asynchronous drafting, and the reference linear density of the yarn is adjusted by the second stage synchronous drafting. The linear density and the blending ratio of the yarn can be dynamically adjusted online by the four-ingredient separate/integrated asynchronous/synchronous two-stage drafting, combined with the spinning device and process of the twisting, which breaks through the three bottlenecks existing in the slub yarn spinning process of the prior art. The three bottlenecks are: 1. only the linear density can be adjusted while the blending ratio (color change) cannot be adjusted; 2. monotonous pattern of the slub yarn; 3. poor reproducibility of the slub yarn pattern.

Calculations for the Processing Parameters of Four-Ingredient Separate/Integrated Asynchronous/Synchronous Two-Stage Drafting Coaxial Twisting Spinning System According to the drafting theory, the drafting ratio of the first stage drafting is:

$$e_{h1} = \frac{V_z}{V_{h1}} = \frac{\rho_1}{\rho_1'} \tag{1}$$

$$e_{h2} = \frac{V_z}{V_{h2}} = \frac{\rho_2}{\rho_2'} \tag{2}$$

$$e_{h3} = \frac{V_z}{V_{h3}} = \frac{\rho_3}{\rho_3'} \tag{3}$$

$$e_{h4} = \frac{V_z}{V_{h4}} = \frac{\rho_4}{\rho_4'} \tag{4}$$

The equivalent drafting ratio of the first stage drafting is:

$$\overline{e}_h = \frac{\rho_1 + \rho_2 + \rho_3 + \rho_4}{\rho_1' + \rho_2' + \rho_3' + \rho_4'} \tag{5}$$

The drafting ratio of the second stage drafting is:

$$e_q = \frac{V_q}{V_z} = \frac{\rho_1'}{\rho_1''} = \frac{\rho_2'}{\rho_2''} = \frac{\rho_3'}{\rho_3''} = \frac{\rho_4'}{\rho_4''} = \frac{\rho_1' + \rho_2' + \rho_3' + \rho_4'}{\rho_1'' + \rho_2'' + \rho_3'' + \rho_4''} \tag{6}$$

The total equivalent drafting ratio e is:

$$\overline{e} = \frac{\rho_1 + \rho_2 + \rho_3 + \rho_4}{\rho_1'' + \rho_2'' + \rho_3'' + \rho_4''} = \overline{e}_h * e_q \tag{7}$$

The total equivalent drafting ratio e is a significant parameter in the spinning process, which is the product of front area drafting ratio and back area drafting ratio.

According to the established spinning model of the invention, the four roving yarns are asynchronously drafted in the back area and synchronously drafted in the front area and then are integrated and twisted to form a yarn, the blending ratios thereof $k_1$, $k_2$, $k_3$, $k_4$ can be expressed as follows:

$$k_1 = \frac{\rho_1''}{\rho_1'' + \rho_2'' + \rho_3'' + \rho_4''} = \frac{\rho_1'}{\rho_1' + \rho_2' + \rho_3' + \rho_4'} = \frac{\rho_1 * V_{h1}}{\rho_1 * V_{h1} + \rho_2 * V_{h2} + \rho_3 * V_{h3} + + \rho_4 * V_{h4}} \tag{8}$$

$$k_2 = \frac{\rho_2''}{\rho_1'' + \rho_2'' + \rho_3'' + \rho_4''} = \frac{\rho_2'}{\rho_1' + \rho_2' + \rho_3' + \rho_4'} = \frac{\rho_2 * V_{h2}}{\rho_1 * V_{h1} + \rho_2 * V_{h2} + \rho_3 * V_{h3} + \rho_4 * V_{h4}} \tag{9}$$

$$k_3 = \frac{\rho_3''}{\rho_1'' + \rho_2'' + \rho_3'' + \rho_4''} = \frac{\rho_3'}{\rho_1' + \rho_2' + \rho_3' + \rho_4'} = \frac{\rho_2 * V_{h3}}{\rho_1 * V_{h1} + \rho_2 * V_{h2} + \rho_3 * V_{h3} + + \rho_4 * V_{h4}} \tag{10}$$

$$k_4 = \frac{\rho_4''}{\rho_1'' + \rho_2'' + \rho_3'' + \rho_4''} = \frac{\rho_4'}{\rho_1' + \rho_2' + \rho_3' + \rho_4'} = \frac{\rho_4 * V_{h4}}{\rho_1 * V_{h1} + \rho_2 * V_{h2} + \rho_3 * V_{h3} + + \rho_4 * V_{h4}} \tag{11}$$

As known from the Equations (8), (9), (10), (11) the blending ratios of the four ingredients in the yarn is related to the surface rotation rates $V_{h1}$, $V_{h2}$, $V_{h3}$, $V_{h4}$ of the back rollers and the linear densities $\rho_1$, $\rho_2$, $\rho_3$, $\rho_4$ of the four roving yarns. Generally, $\rho_1$, $\rho_2$, $\rho_3$, $\rho_4$ are constant and irrelevant to the time, while $V_{h1}$, $V_{h2}$, $V_{h3}$, $V_{h4}$ are related to the speed of the main shaft. Because the main shaft speed has a bearing on the spinner production, different main shaft speeds are adopted for different materials and product specifications in different enterprises. As such, even though $\rho_1$, $\rho_2$, $\rho_3$, $\rho_4$ of the roving yarns are constant, the blending ratios determined by Equations (8), (9), (10), (11) change due to the speed change of the main shaft, which results in the changes of $V_{h1}$, $V_{h2}$, $V_{h3}$, $V_{h4}$ rendering the blending ratios uncertain.

In the same way, the four roving yarns are two-stage drafted, integrated and twisted to form a yarn with the following linear density:

$$\rho_y = \frac{\rho_1 + \rho_2 + \rho_3 + \rho_4}{\overline{e}} = \rho_1'' + \rho_2'' + \rho_3'' + \rho_4''$$

$$\rho_y = \frac{V_z}{V_q} * \rho_1' + \frac{V_z}{V_q} * \rho_2' + \frac{V_z}{V_q} * \rho_3' + \frac{V_z}{V_q} * \rho_4'$$

$$\rho_y = \frac{V_z}{V_q} * \frac{V_{h1}}{V_z} * \rho_1 + \frac{V_z}{V_q} * \frac{V_{h2}}{V_z} \rho_2 + \frac{V_z}{V_q} * \frac{V_{h3}}{V_z} \rho_3 + \frac{V_z}{V_q} * \frac{V_{h4}}{V_z} \rho_4$$

and then the linear density of the yarn is:

$$\rho_y = \frac{1}{V_q}(V_{h1} * \rho_1 + V_{h2} * \rho_2 + V_{h3} * \rho_3 + V_{h4} * \rho_4) \tag{12}$$

As known from Equation (12), the linear density of the yarn is related to the speed $V_{h1}$, $V_{h2}$, $V_{h3}$, $V_{h4}$ of the combination of back rollers and the linear densities $\rho_1$, $\rho_2$, $\rho_3$, $\rho_4$ of the four roving yarns. Generally, $\rho_1$, $\rho_2$, $\rho_3$, $\rho_4$ are constant and irrelevant to the time while $V_{h1}$, $V_{h2}$, $V_{h3}$, $V_{h4}$ are related to the main shaft speed set by the spinning machine. Because the main shaft speed has a bearing on the production of the spinning machine, different main shaft speeds would be adopted when spinning the different materials with different product specifications in different enterprises. As such, for the linear density determined by Equation (8), even though $\rho_1$, $\rho_2$, $\rho_3$, $\rho_4$ of the four roving yarns remain unchanged, $V_{h1}$, $V_{h2}$, $V_{h3}$, $V_{h4}$ would change with the main shaft speed, rendering the linear density uncertain.

From Equation (1):

$$\rho_1' = \frac{V_{h1}}{V_z} * \rho_1$$

From Equation (2):

$$\rho_2' = \frac{V_{h2}}{V_z} * \rho_2$$

From Equation (3):

$$\rho_3' = \frac{V_{h3}}{V_z} * \rho_3$$

From Equation (4):

$$\rho_4' = \frac{V_{h4}}{V_z} * \rho_4$$

$$\therefore \quad \rho_1' + \rho_2' + \rho_3' + \rho_4' = \frac{V_{h1} * \rho_1 + V_{h2} * \rho_2 + V_{h3} * \rho_3 + V_{h4} * \rho_4}{V_z} \tag{13}$$

Equation (11) is substituted in Equation (5) and then solved for the equivalent drafting ratio $\bar{e}_h$:

$$\bar{e}_n = \frac{\rho_1 + \rho_2 + \rho_3 + \rho_4}{V_{h1} * \rho_1 + V_{h2} * \rho_2 + V_{h3} * \rho_3 + V_{h4} * \rho_4} * V_z \tag{14}$$

Equation (14) is substituted in Equation (7) and then solved for the total equivalent drafting ratio $\bar{e}$:

$$\bar{e} = \frac{\rho_1 + \rho_2 + \rho_3 + \rho_4}{V_{h1} * \rho_1 + V_{h2} * \rho_2 + V_{h3} * \rho_3 + V_{h4} * \rho_4} * V_z * \frac{V_q}{V_z} \tag{15}$$

-continued $$\bar{e} = \frac{\rho_1 + \rho_2 + \rho_3 + \rho_4}{V_{h1} * \rho_1 + V_{h2} * \rho_2 + V_{h3} * \rho_3 + V_{h4} * \rho_4} * V_q$$

To negate the changes caused by the different main shaft speeds, the limited condition is provided as follows:

$$\rho_1 = \rho_2 = \rho_3 = \rho_4 = \rho \tag{16}$$

Equation (12) is substituted in Equation (9):

$$\rho_1' + \rho_2' + \rho_3' + \rho_4' = \rho * \frac{(V_{h1} + V_{h2} + V_{h3} + V_{h4})}{V_z} \tag{17}$$

Equations (12), (13) are substituted in Equation (10):

$$\bar{e}_n = \frac{V_z}{\frac{(V_{h1} + V_{h2} + V_{h3} + V_{h4})}{4}} \tag{18}$$

Equations (14) is substituted in Equation (5):

$$\bar{e} = \bar{e}_n * e_q = \frac{V_q}{\frac{(V_{h1} + V_{h2} + V_{h3} + V_{h4})}{4}} \tag{19}$$

Equations (17), (18), (19) are substituted in Equations (8), (9), (10), (11):

$$k_1 = \frac{V_{h1}}{V_{h1} + V_{h2} + V_{h3} + V_{h4}} = \frac{V_z}{V_{h1} + V_{h2} + V_{h3} + V_{h4}} * \frac{1}{e_{h1}} \tag{20}$$

$$k_2 = \frac{V_{h2}}{V_{h1} + V_{h2} + V_{h3} + V_{h4}} = \frac{V_z}{V_{h1} + V_{h2} + V_{h3} + V_{h4}} * \frac{1}{e_{h2}} \tag{21}$$

$$k_3 = \frac{V_{h3}}{V_{h1} + V_{h2} + V_{h3} + V_{h4}} = \frac{V_z}{V_{h1} + V_{h2} + V_{h3} + V_{h4}} * \frac{1}{e_{h3}} \tag{22}$$

$$k_4 = \frac{V_{h4}}{V_{h1} + V_{h2} + V_{h3} + V_{h4}} = \frac{V_z}{V_{h1} + V_{h2} + V_{h3} + V_{h4}} * \frac{1}{e_{h4}} \tag{23}$$

As known from the equations (17) and (18), the changes of the blending ratios all depend on the changes of $(V_{h1}+\Delta V_{h1})+(V_{h2}+\Delta V_{h2})+(V_{h3}+\Delta V_{h3})+(V_{h4}+\Delta V_{h4})$, i.e., the changes of speeds of the four back rollers.

$$k_1 = \frac{V_{h1} + \Delta V_{h1}}{V_{h1} + \Delta V_{h1} + V_{h2} + \Delta V_{h2} + V_{h3} + \Delta V_{h3} + V_{h4} + \Delta V_{h4}}$$

$$k_2 = \frac{V_{h2} + \Delta V_{h2}}{V_{h1} + \Delta V_{h1} + V_{h2} + \Delta V_{h2} + V_{h3} + \Delta V_{h3} + V_{h4} + \Delta V_{h4}}$$

$$k_3 = \frac{V_{h3} + \Delta V_{h3}}{V_{h1} + \Delta V_{h1} + V_{h2} + \Delta V_{h2} + V_{h3} + \Delta V_{h3} + V_{h4} + \Delta V_{h4}}$$

$$k_4 = \frac{V_{h4} + \Delta V_{h4}}{V_{h1} + \Delta V_{h1} + V_{h2} + \Delta V_{h2} + V_{h3} + \Delta V_{h3} + V_{h4} + \Delta V_{h4}}$$

In a special condition, $\Delta V_{h1}+\Delta V_{h2}+\Delta V_{h3}+\Delta V_{h4}=0$, then the above equation can be simplified as:

$$k_1 = \frac{V_{h1} + \Delta V_{h1}}{V_{h1} + V_{h2} + V_{h3} + V_{h4}}$$

$$k_1 = \frac{V_{h1} + \Delta V_{h1}}{V_{h1} + V_{h2} + V_{h3} + V_{h4}}$$

$$k_2 = \frac{V_{h2} + \Delta V_{h2}}{V_{h1} + V_{h2} + V_{h3} + V_{h4}}$$

$$k_3 = \frac{V_{h3} + \Delta V_{h3}}{V_{h1} + V_{h2} + V_{h3} + V_{h4}}$$

$$k_4 = \frac{V_{h4} + \Delta V_{h4}}{V_{h1} + V_{h2} + V_{h3} + V_{h4}}$$

Further in a special condition, $V_{h1}+V_{h2}+V_{h3}+V_{h4}=V_Z$ i.e., the sum of the speeds of the four back rollers is equal to the linear speed of the middle roller, then the above four equations can be further simplified as:

$$k_1 = \frac{V_{h1}}{V_z} = \frac{1}{e_{h1}}$$

$$k_2 = \frac{V_{h2}}{V_z} = \frac{1}{e_{h2}}$$

$$k_3 = \frac{V_{h3}}{V_z} = \frac{1}{e_{h3}}$$

$$k_4 = \frac{V_{h4}}{V_z} = \frac{1}{e_{h4}}$$

The blending ratios of the four ingredients $\rho_1$, $\rho_2$, $\rho_3$, $\rho_4$ in the yarn are equal to the inverses of their respective drafting ratios.

$$e_{h1} = \frac{V_z}{V_{h1}} = \frac{1}{k_1}$$

$$e_{h2} = \frac{V_z}{V_{h2}} = \frac{1}{k_2}$$

$$e_{h3} = \frac{V_z}{V_{h3}} = \frac{1}{k_3}$$

$$e_{h4} = \frac{V_z}{V_{h4}} = \frac{1}{k_4}$$

For example, assuming:

$k_1$=0, 0.1, 0.2, 0.3, 0.4, 0.5, 0.6, 0.7, 0.8, 0.9, 1

$k_2$=0.7, 0.6, 0.5, 0.4, 0.3, 0.2, 0.1, 0, 0.1, 0.1, 0

$k_3$=0.2, 0.2, 0.2, 0.2, 0.2, 0.2, 0.2, 0.2, 0.1, 0, 0

$k_4$=0.1, 0.1, 0.1, 0.1, 0.1, 0.1, 0.1, 0.1, 0, 0, 0

$e_{h1}$, $e_{h2}$, $e_{h3}$ and $e_{h4}$ can be calculated as listed by Table 2.

TABLE 2

| Blending ratio and first-stage drafting | | | | | | | | | | | |
|---|---|---|---|---|---|---|---|---|---|---|---|
| $k_1$ | 0 | 0.1 | 0.2 | 0.3 | 0.4 | 0.5 | 0.6 | 0.7 | 0.8 | 0.9 | 1 |
| $e_{h1}$ | X | 10 | 5 | 10/3 | 10/4 | 10/5 | 10/6 | 10/7 | 10/8 | 10/9 | 1 |
| $k_2$ | 0.7 | 0.6 | 0.5 | 0.4 | 0.3 | 0.2 | 0.1 | 0 | 0.1 | 0.1 | 0 |
| $e_{h2}$ | 10/7 | 10/6 | 10/5 | 10/4 | 10/3 | 5 | 10 | X | 10 | 10 | X |
| $k_3$ | 0.2 | 0.2 | 0.2 | 0.2 | 0.2 | 0.2 | 0.2 | 0.2 | 0.1 | 0 | 0 |
| $e_{h3}$ | 10/2 | 10/2 | 10/2 | 10/2 | 10/2 | 10/2 | 10/2 | 10/2 | 10 | X | X |
| $k_4$ | 0.1 | 0.1 | 0.1 | 0.1 | 0.1 | 0.1 | 0.1 | 0.1 | 0 | 0 | 0 |
| $e_{h4}$ | 10 | 10 | 10 | 10 | 10 | 10 | 10 | 10 | X | X | X |

DETAILED DESCRIPTION OF THE INVENTION

Figure 1:
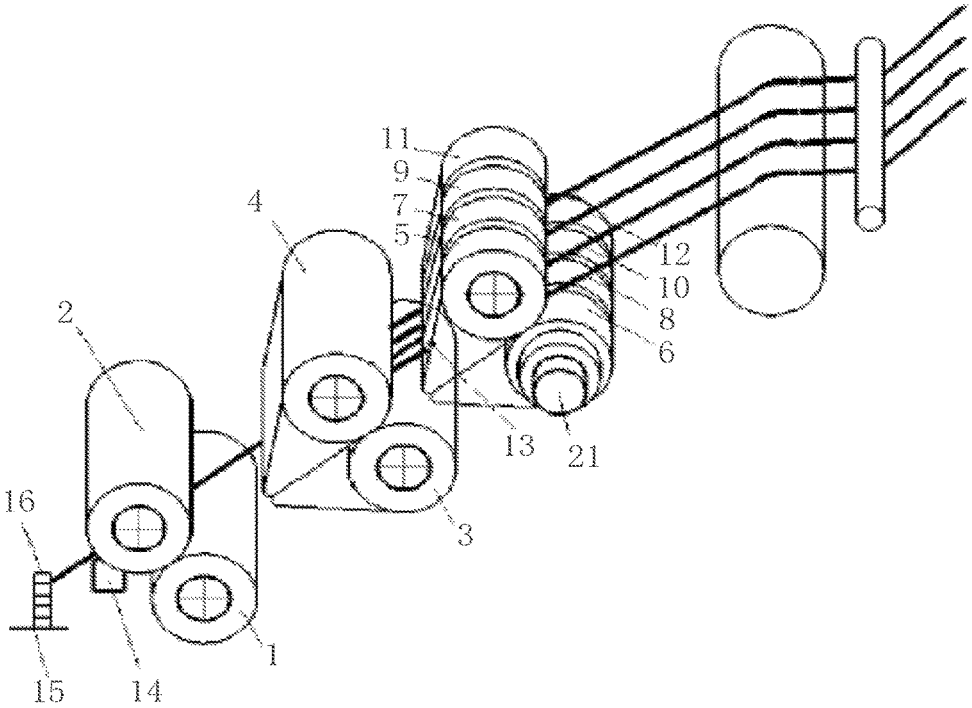
FIG. 1 is a principle schematic diagram of the two-stage drafting spinning device.

The embodiments of the invention are described as below, in combination with the accompanying drawings.

Embodiment 1

A method and device of configuring linear density and blending ratio of yarn by four-ingredient asynchronous/synchronous drafted is disclosed, comprising:

1) as shown in FIGS. 1-5, a drafting and twisting system includes a first stage drafting unit and a successive second stage drafting unit;

2) the first stage drafting unit includes a combination of back rollers and a middle roller 3; the combination of back rollers has four rotational degrees of freedom and includes a first back roller 6, a second back roller 8, a third back roller 10, a fourth back roller 12, which are set abreast on a same back roller shaft; the second stage drafting unit includes a front roller land the middle roller 3.

4 is the top roller of middle roller 3, 5, 7, 9, 11 are the top rollers of four back rollers respectively. 2 is the top roller of front roller 1. $O_1$,$O'_1$, $O_2$,$O'_2$, $O_3$,$O'_3$ respectively refer to axis lines of back rollers, the middle roller and the front roller. The first stage drafting is implemented by the middle roller and the back rollers and the second drafting is implemented by the front roller and the middle roller. 15 is the winding device and 14 is guider roller. 16 is the yarn Y.

Figure 2:
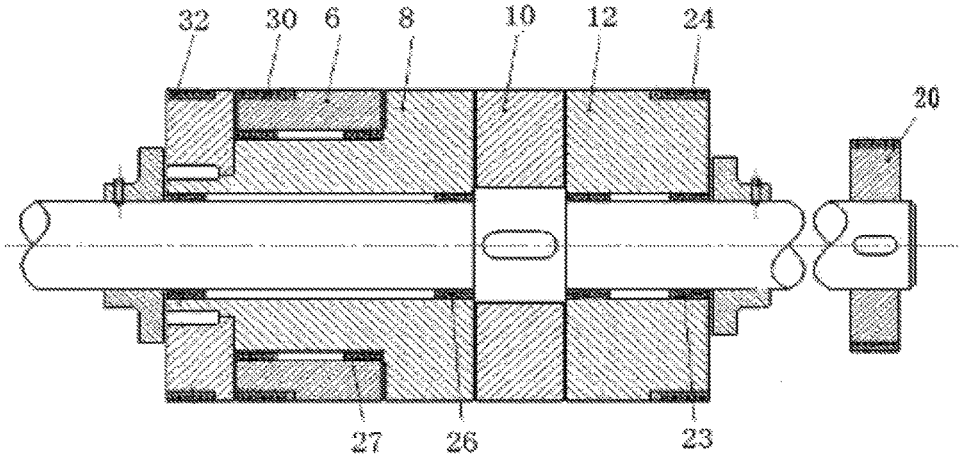
FIG. 2 is a structural schematic diagram of a combination of back rollers.
Figure 3:
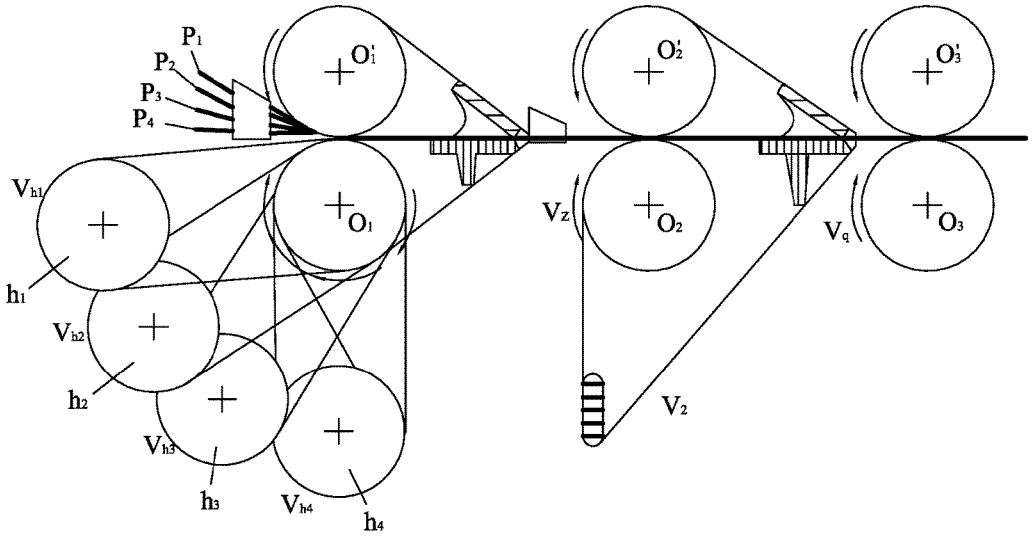
FIG. 3 is a structural side view of the two-stage drafting spinning device.
Figure 4:
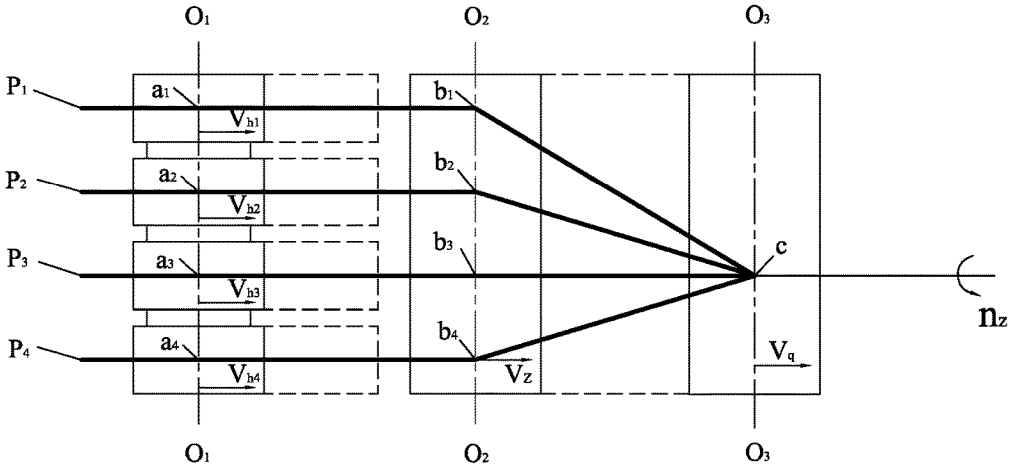
FIG. 4 is a yarn route of the two-stage drafting in an embodiment.

FIG. 2 shows a four-nested combination of back rollers with four rotational degrees of freedom. The four movable back rollers 6,8,10,12 are respectively driven by a core shaft and pulleys 20, 24, 30 and 32. The first back roller, the second back roller, the third back roller and the fourth back roller move at the speeds $V_{h1}$, $V_{h2}$, $V_{h3}$, and $V_{h4}$ respectively; the middle roller rotates at the speed $V_z$; the front roller rotates at the surface linear speed $V_q$. Assuming the linear densities of a first roving yarn ingredient, a second roving yarn ingredient, a third roving yarn ingredient, a fourth roving yarn ingredient drafted by the first back roller, the second back roller, the third back roller and the fourth back roller are respectively $\rho_1$, $\rho_2$, $\rho_3$, and $\rho_4$, the linear density of the yarn Y drafted and twisted by the front roller is $\rho_y$.

The four coaxial back rollers with the same diameters correspond with four coaxial top rollers with the same diameters. The roving yarns are held by the four pairs of parallel arranged upper aprons and corresponding lower aprons located in the back area. When spinning, the four roving yarns are located by a guide rod and a bell mouth in the process of drafting and twisting, to travel according to the route showed in FIG. 4. The four roving yarns $\rho_1$, $\rho_2$, $\rho_3$, $\rho_4$ are fed into the first stage drafting area via the jaws $a_1$, $a_2$, $a_3$, $a_4$ of the back rollers at different speeds, and travel in parallel to the holding points $b_1$, $b_2$, $b_3$, $b_4$ and output at the speed $V_z$. The linear densities of the four strands are respectively $\rho_{1'}$, $\rho_{2'}$, $\rho_{3'}$, $\rho_{4'}$. Then the four strands enter into the second stage drafting area and integrate at the jaw c of the front roller. The linear densities of the four strands are changed to $\rho_{1''}$, $\rho_{2''}$, $\rho_{3''}$, $\rho_{4''}$ after synchronously drafted by the front roller at the surface speed $V_q$. The four strands are integrated at the jaw c of the front roller and then twisted together to form the yarn Y $$\rho_y = \frac{1}{V_q}(V_{h1} * \rho_1 + V_{h2} * \rho_2 + V_{h3} * \rho_3 + V_{h4} * \rho_4) \tag{1}$$

3) The second stage drafting unit includes the front roller and the middle roller; the front roller moves at the speed $V_q$;

4) The speed $V_q$ of the front roller and the speed $V_z$ of the middle roller are kept constant, and only the speeds of first back roller, the second back roller, the third back roller and the fourth back roller are adjusted, and the linear density or/and the blending ratio of the yarn can be adjusted.

The Specific Adjusting Method for the Linear Density:

Assuming the linear densities of a first roving yarn ingredient, a second roving yarn ingredient, a third roving yarn ingredient, a fourth roving yarn ingredient drafted by the first back roller, the second back roller, the third back roller and the fourth back roller are respectively $\rho_1$, $\rho_2$, $\rho_3$, and $\rho_4$, the linear density of the yarn Y drafted and twisted by the front roller is $\rho_y$.

$$\rho_y = \frac{1}{V_q}(V_{h1} * \rho_1 + V_{h2} * \rho_2 + V_{h3} * \rho_3 + V_{h4} * \rho_4)$$

1) change the speed of any of the first back roller, the second back roller, the third back roller, the fourth back roller, and keep the speeds of the other three backer rollers unchanged, and then the yarn ingredient of the yarn Y drafted by this back roller and the linear density thereof change accordingly. The linear density $\rho'_y$ of the yarn Y is adjusted as:

$$\rho'_y = \rho_y + \Delta\rho_y = \frac{\rho}{V_q} * (V_{h1} + V_{h2} + V_{h3} + V_{h4} + \Delta V_{h4})$$

-continued or $$\rho'_y = \rho_y + \Delta\rho_y = \frac{\rho}{V_q} * (V_{h1} + V_{h2} + V_{h3} + V_{h4} + \Delta V_{h3})$$

or $$\rho'_y = \rho_y + \Delta\rho_y = \frac{\rho}{V_q} * (V_{h1} + V_{h2} + V_{h3} + V_{h4} + \Delta V_{h2})$$

or $$\rho'_y = \rho_y + \Delta\rho_y = \frac{\rho}{V_q} * (V_{h1} + V_{h2} + V_{h3} + V_{h4} + \Delta V_{h1})$$

wherein $\Delta\rho_y$ is a linear density change of the yarn, $\Delta V_{h1}$, $\Delta V_{h2}$, $\Delta V_{h3}$ and $\Delta V_{h4}$ is a speed change of the first back roller, second, third and fourth respectively.

2) change the speeds of any two back rollers of the first back roller, the second back roller, the third back roller, the fourth back roller, and keep the speeds of the other two backer rollers unchanged, the yarn ingredients of the yarn Y drafted by these any two back rollers and the linear densities thereof change accordingly. The linear density $\rho'_y$ of the yarn Y is adjusted as:

$$\rho'_y = \rho_y + \Delta\rho_y = \frac{\rho}{V_q} * [V_{h1} + V_{h2} + V_{h3} + V_{h4} + (\Delta V_{h1} + \Delta V_{h2})]$$

or $$\rho'_y = \rho_y + \Delta\rho_y = \frac{\rho}{V_q} * [V_{h1} + V_{h2} + V_{h3} + V_{h4} + (\Delta V_{h1} + \Delta V_{h4})]$$

or $$\rho'_y = \rho_y + \Delta\rho_y = \frac{\rho}{V_q} * [V_{h1} + V_{h2} + V_{h3} + V_{h4} + (\Delta V_{h1} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h2} + \Delta V_{h4})]$$

or $$\rho'_y = \rho_y + \Delta\rho_y = \frac{\rho}{V_q} * [V_{h1} + V_{h2} + V_{h3} + V_{h4} + (\Delta V_{h3} + \Delta V_{h4})]$$

3) change the speeds of any three back rollers of the first back roller, the second back roller, the third back roller, the fourth back roller simultaneously, and keep the speeds of the other one backer rollers unchanged, the yarn ingredients of the yarn Y drafted by these any three back rollers and the linear densities thereof change accordingly. The linear density $\rho'_y$ of yarn Y is adjusted as:

$$\rho'_y = \rho_y + \Delta\rho_y = \frac{\rho}{V_q} * [V_{h1} + V_{h2} + V_{h3} + V_{h4} + (\Delta V_{h1} + \Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h4} + \Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h4} + \Delta V_{h1} + \Delta V_{h3})]$$

-continued or $$\rho'_y = \rho_y + \Delta\rho_y = \frac{\rho}{V_q} * [V_{h1} + V_{h2} + V_{h3} + V_{h4} + (\Delta V_{h4} + \Delta V_{h2} + \Delta V_{h1})]$$

4) change the speeds of the first back roller, the second back roller, the third back roller and the fourth back roller simultaneously, and the sum of the speeds of the four back rollers is unequal to zero. The yarn ingredients of the yarn Y drafted by these four back rollers and the linear densities thereof change accordingly. The linear density $\rho'_y$ of the yarn Y is adjusted as:

$$\rho'_y = \rho_y + \Delta\rho_y = \frac{\rho}{V_q} * [V_{h1} + V_{h2} + V_{h3} + V_{h4} + (\Delta V_{h1} + \Delta V_{h2} + \Delta V_{h3} + \Delta V_{h4})]$$

5) change the speeds of the first back roller, the second back roller, the third back roller, and the fourth back roller, and make the speed of any of back rollers equal to zero, while the speeds of the other three backer rollers unequal to zero. The yarn ingredient of the yarn Y drafted by the any one of back rollers is thus discontinuous, while the other four yarn ingredients are continuous. The linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{h1} + \Delta V_{h1}) + (V_{h2} + \Delta V_{h2}) + (V_{h3} + \Delta V_{h3})] \quad (T_1 \le t \le T_2)$$

or $$\rho'_y = \frac{\rho}{V_q} * [(V_{h1} + \Delta V_{h1}) + (V_{h4} + \Delta V_{h4}) + (V_{h3} + \Delta V_{h3})] \quad (T_1 \le t \le T_2)$$

or $$\rho'_y = \frac{\rho}{V_q} * [(V_{h4} + \Delta V_{h4}) + (V_{h2} + \Delta V_{h2}) + (V_{h3} + \Delta V_{h3})] \quad (T_1 \le t \le T_2)$$

or $$\rho'_y = \frac{\rho}{V_q} * [(V_{h1} + \Delta V_{h1}) + (V_{h2} + \Delta V_{h2}) + (V_{h4} + \Delta V_{h4})] \quad (T_1 \le t \le T_2)$$

wherein $T_1$, and $T_2$ are time points, and t is a time variable.

6) change the speeds of the first back roller, the second back roller, the third back roller, and the fourth back roller, and make the speeds of any two back rollers equal to zero, while the speeds of the other two backer rollers unequal to zero. The yarn ingredients of the yarn Y drafted by the any two back rollers are thus discontinuous, while the other two yarn ingredients are continuous. The linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hi} + \Delta V_{hi}) + (V_{hj} + \Delta V_{hj})] \quad (T_1 \le t \le T_2)$$

wherein $T_1$, and $T_2$ are time points, and t is a time variable; $i \neq j$ and $i,j \in (1,2,3,4)$.

7) change the speeds of the first back roller, the second back roller, the third back roller, and the fourth back roller, and make the speeds of any three back rollers equal to zero, while the speeds of the other one backer rollers unequal to zero. The yarn ingredients of the yarn Y drafted by the any three back rollers are thus discontinuous, while the other one yarn ingredients are continuous. The linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hj} + \Delta V_{hj})] \quad (T_1 \le t \le T_2)$$

wherein $T_1$, and $T_2$ are time points, and t is a time variable; $j \in (1,2,3,4)$.

8) change the speeds of the first back roller, the second back roller, the third back roller, and the fourth back roller, and make the speeds of any two back rollers equal to zero successively, while the speeds of the other two backer rollers unequal to zero. The yarn ingredients of the yarn Y drafted by the any two back rollers are thus discontinuous successively, while the other two yarn ingredients are continuous. The linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hi} + \Delta V_{hi}) + (V_{hj} + \Delta V_{hj}) + (V_{hk} + \Delta V_{hk})] \quad (T_1 \le t \le T_2)$$

$$\rho'_y = \frac{\rho}{V_q} * [(V_{hi} + \Delta V_{hi}) + (V_{hj} + \Delta V_{hj})] \quad (T_2 \le t \le T_3)$$

wherein $T_1$, $T_2$ and $T_3$ are time points, and t is a time variable; $i \neq j \neq k$ and $i,j,k \in (1,2,3,4)$.

9) change the speeds of the first back roller, the second back roller, the third back roller, and the fourth back roller, and make the speeds of any three back rollers equal to zero successively, while the speeds of the other one backer rollers unequal to zero. The yarn ingredients of the yarn Y drafted by the any three back rollers are thus discontinuous successively, while the other yarns ingredients are continuous. The linear density $\rho'_y$ of yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hi} + \Delta V_{hi}) + (V_{hj} + \Delta V_{hj}) + (V_{hk} + \Delta V_{hk})] \quad (T_1 \le t \le T_2)$$

$$\rho'_y = \frac{\rho}{V_q} * [(V_{hi} + \Delta V_{hi}) + (V_{hj} + \Delta V_{hj})] \quad (T_2 \le t \le T_3)$$

$$\rho'_y = \frac{\rho}{V_q} * [(V_{hi} + \Delta V_{hi})] \quad (T_3 \le t \le T_4)$$

wherein $T_1$, $T_2$, $T_3$ and $T_4$ are time points, and t is a time variable; $i \neq j \neq k$ and $i,j,k \in (1,2,3,4)$.

The specific adjusting method for blending ratio:

change the speeds of the first back roller, the second back roller, the third back roller, and the fourth back roller, and keep $$V_{h1}*\rho_1+V_{h2}*\rho_2+V_{h3}*\rho_3+V_{h4}*\rho_4=\text{constant}$$

assuming $\rho_1=\rho_2=\rho_3=\rho_4=\beta$ then linear density of the yarn Y is thus fixed while the blending ratios of the ingredients thereof change; the blending ratios $k_1$, $k_2$, $k_3$ and $k_4$ of the first yarn ingredient, the second yarn ingredient, the third yarn ingredient, and the fourth yarn ingredient are provided as below:

$$k_j = \frac{V_{hj} + \Delta V_{hj}}{V_{h1} + \Delta V_{h1} + V_{h2} + \Delta V_{h2} + V_{h3} + \Delta V_{h3} + V_{h4} + \Delta V_{h4}}$$

wherein $j \in (1,2,3,4)$ let $\beta_1=\rho_2=\rho_3=\rho_4=\rho$ and adjust the speeds of the first back roller, the second back roller, the third back roller, and the fourth back roller by $V_{h1}+V_{h2}+V_{h3}+V_{h4}=V_Z$, i.e., the sum of the linear speeds of the four back rollers is equal to the linear speed of the middle roller, then:

$$k_1 = \frac{V_{h1}}{V_z} = \frac{1}{e_{h1}}$$

$$k_2 = \frac{V_{h2}}{V_z} = \frac{1}{e_{h2}}$$

$$k_3 = \frac{V_{h3}}{V_z} = \frac{1}{e_{h3}}$$

$$k_4 = \frac{V_{h4}}{V_z} = \frac{1}{e_{h4}}$$

i.e., the blending ratios of the four yarn ingredients $\rho 1$, $\rho_2$, $\rho_3$, $\rho_4$ of the yarn Y are equal to the inverses of their drafting ratios in the first stage drafting area $$e_{h1} = \frac{V_z}{V_{h1}} = \frac{1}{k_1}$$

$$e_{h2} = \frac{V_z}{V_{h2}} = \frac{1}{k_2}$$

$$e_{h3} = \frac{V_z}{V_{h3}} = \frac{1}{k_3}$$

$$e_{h4} = \frac{V_z}{V_{h4}} = \frac{1}{k_4}$$

Wherein there is an integrator between the combination of back rollers and the middle roller, the speed of the middle roller is kept unchanged, and then the first stage drafting unit functions as a blended or color-mixing unit, and the second stage drafting unit functions as a pure liner density regulating unit.

By controlling the operating speed of the middle roller, without regard for the later linear density adjusting process, the yarn can be blended more even and thorough, preventing the influences on the blending process from the linear density adjusting process. Further, the yarn can be ensured to be blended more evenly by controlling the speed of the middle roller under $V_{h1}+V_{h2}+V_{h3}+V_{h4}$.

Embodiment 2

The method of this embodiment is substantially the same as Embodiment 1, and the differences are:

The yellow, magenta, cyan, and black yarns are respectively drafted by the first back roller, the second back roller, the third back roller, and the fourth back roller; the speed $V_q$ of the front roller is kept constant and the speeds of the first back roller, the second back roller, the third back roller, and the fourth back roller are adjusted to regulate the colors of the yarns; when blending the colors, the color depth or the saturation of the colored spun yarn is adjusted by the black yarn.

Linear density of yellow, magenta, cyan, and black yarns are $\beta_1$, $\rho_2$, $\rho_3$ and $\rho_4$ respectively. Let $$V_{h1}*\beta_1+V_{h2}*\beta_2+V_{h3}*\rho_3+V_{h4}*\rho_4=\text{constant}$$

or $$\frac{\rho_1}{E_1} + \frac{\rho_2}{E_2} + \frac{\rho_3}{E_3} + \frac{\rho_4}{E_4} = \text{constant}$$

then the linear density of blended yarn can be unchanged.

Wherein $E_i=V_q/V_{hi}$ is the drafting ratio of front roller to the i back roller, i=1, 2, 3.

In this invention, blending ratios of yellow, magenta, cyan, and black yarns are respectively adjusted by changing the speed of first back roller, the second back roller, the third back roller and the fourth back roller respectively. Blending ratios of the four basic color are as followings:

$$K_1 = \frac{\rho_1'}{\rho_1' + \rho_2' + \rho_3' + \rho_4'} = \frac{\rho_1 / E_1}{\rho_1 / E_1 + \rho_2 / E_2 + \rho_3 / E_3 + \rho_4 / E_4} = \frac{V_{h1} \times \rho_1}{V_{h1} \times \rho_1 + V_{h2} \times \rho_2 + V_{h3} \times \rho_3 + V_{h4} \times \rho_4}$$

$$K_2 = \frac{\rho_2'}{\rho_1' + \rho_2' + \rho_3' + \rho_4'} = \frac{\rho_1 / E_2}{\rho_1 / E_1 + \rho_2 / E_2 + \rho_3 / E_3 + \rho_4 / E_4} = \frac{V_{h1} \times \rho_1}{V_{h1} \times \rho_1 + V_{h2} \times \rho_2 + V_{h3} \times \rho_3 + V_{h4} \times \rho_4}$$

$$K_3 = \frac{\rho_3'}{\rho_1' + \rho_2' + \rho_3' + \rho_4'} = \frac{\rho_3 / E_3}{\rho_1 / E_1 + \rho_2 / E_2 + \rho_3 / E_3 + \rho_4 / E_4} = \frac{V_{h1} \times \rho_3}{V_{h1} \times \rho_1 + V_{h2} \times \rho_2 + V_{h3} \times \rho_3 + V_{h4} \times \rho_4}$$

$$K_4 = \frac{\rho_4'}{\rho_1' + \rho_2' + \rho_3' + \rho_4'} = \frac{\rho_4 / E_4}{\rho_1 / E_1 + \rho_2 / E_2 + \rho_3 / E_3 + \rho_4 / E_4} = \frac{V_{h4} \times \rho_4}{V_{h1} \times \rho_1 + V_{h2} \times \rho_2 + V_{h3} \times \rho_3 + V_{h4} \times \rho_4}$$

Let $\rho_1=\rho_2=\rho_3=\rho_4$, the sum of linear speeds of the first back roller, the second back roller, the third back roller and the fourth back roller are unchanged, thus $V_{h1}+V_{h2}+V_{h3}+V_{h4}$=constant, blending ratios of different base colors in the yarn can be adjusted by changing $V_{h1}$, $V_{h2}$, $V_{h3}$, $V_{h4}$. For example, the blending ratios are calculated as followings:

$$K_1 = \frac{V_{h1}}{V_{h1} + V_{h2} + V_{h3} + V_{h4}}$$

$$K_2 = \frac{V_{h2}}{V_{h1} + V_{h2} + V_{h3} + V_{h4}}$$

-continued $$K_3 = \frac{V_{h3}}{V_{h1} + V_{h2} + V_{h3} + V_{h4}}$$

$$K_4 = \frac{V_{h4}}{V_{h1} + V_{h2} + V_{h3} + V_{h4}}$$

Therefore the process of calculations of the blending ratio is simplified and the efficiency are improved, also the mixed color are more accurate.

Embodiment 3

The method of this embodiment is substantially the same as Embodiment 1, and the differences are:

1) According to the set blending ratio and/or linear density, divide the yarn Y into n segments. The linear density and blending ratio of each segment of yarn Y are the same, while the linear densities and blending ratios of the adjacent segments are different; when drafting the segment i of the yarn Y, the linear speeds of the first back roller, the second back roller, the third back roller and the fourth back roller are $V_{h1i}$, $V_{h2i}$, $V_{h3i}$, $V_{h4i}$, wherein $i \in (1, 2, \ldots, n)$; the first roving yarn ingredient, the second roving yarn ingredient, the third roving yarn ingredient, the fourth roving yarn ingredient are two-stage drafted and twisted to form segment i of yarn Y, and the blending ratios $k_{1i}$, $k_{2i}$, $k_{3i}$ and $k_{4i}$ thereof are expressed as below:

$$k_{1i} = \frac{\rho_1 * V_{h1i}}{\rho_1 * V_{h1i} + \rho_2 * V_{h2i} + \rho_3 * V_{h3i} + \rho_4 * V_{h4i}} \quad (2)$$

$$k_{2i} = \frac{\rho_2 * V_{h2i}}{\rho_1 * V_{h1i} + \rho_2 * V_{h2i} + \rho_3 * V_{h3i} + \rho_4 * V_{h4i}} \quad (3)$$

$$k_{3i} = \frac{\rho_3 * V_{h3i}}{\rho_1 * V_{h1i} + \rho_2 * V_{h2i} + \rho_3 * V_{h3i} + \rho_4 * V_{h4i}} \quad (4)$$

$$k_{4i} = \frac{\rho_4 * V_{h4i}}{\rho_1 * V_{h1i} + \rho_2 * V_{h2i} + \rho_3 * V_{h3i} + \rho_4 * V_{h4i}} \quad (5)$$

the linear density of the segment i of yarn Y is:

$$\rho_{yi} = \frac{V_s}{V_q}\left(\frac{V_{h1i}}{V_z} * \rho_1 + \frac{V_{h2i}}{V_z}\rho_2 + \frac{V_{h3i}}{V_z}\rho_3 + \frac{V_{h1i}}{V_z}\rho_4\right) = \frac{1}{e_q} * \left(\frac{V_{h1i}}{V_z} * \rho_1 + \frac{V_{h2i}}{V_z}\rho_2 + \frac{V_{h3i}}{V_z}\rho_3 + \frac{V_{h4i}}{V_z}\rho_4\right) \quad (6)$$

wherein $$e_q = \frac{V_q}{V_z}$$

is the two-stage drafting ratio;

2) Take the segment with the lowest density as a reference segment, whose reference linear density is $\rho_0$; the reference linear speeds of the first back roller, the second back roller, the third back roller and the fourth back roller for this segment are respectively $V_{h10}$, $V_{h20}$, $V_{h30}$, and $V_{h40}$; and the reference blending ratios of the first roving yarn ingredient, the second roving yarn ingredient, the third roving yarn ingredient, the fourth roving yarn ingredient for this segment are respectively $k_{10}$, $k_{20}$, $k_{30}$, and $k_{40}$, keep the linear speed of the middle roller constant, and $$V_Z = V_{h10} + V_{h20} + V_{h30} + V_{h40} \quad (7);$$

also keep two-stage drafting ratio $$e_q = \frac{V_q}{V_z}$$

is constant;

wherein the reference linear speeds of the first back roller, the second back roller, the third back roller and the fourth back roller for this segment are respectively $V_{h10}$, $V_{h20}$, $V_{h30}$, and $V_{h40}$, which can be predetermined according to the material, the reference linear density $\rho_0$ and the reference blending ratios $k_{10}$, $k_{20}$, $k_{30}$, and $k_{40}$ of the first roving yarn ingredient, the second roving yarn ingredient, the third roving yarn ingredient, and the fourth roving yarn ingredient.

3) When the segment i of the yarn Y is drafted and blended, on the premise of known set linear density $\rho_{yi}$ and blending ratios $k_{1i}$, $k_{2i}$, $k_{3i}$, and $k_{4i}$, the linear speeds $V_{h1i}$, $V_{h2i}$, $V_{h3i}$, and $V_{h4i}$ of the first back roller, the second back roller, the third back roller, the the fourth back roller are calculated according to Equations (2)-(7);

4) Based on the reference linear speeds $V_{h10}$, $V_{h20}$, $V_{h30}$, and $V_{h40}$ for the reference segment, increase or decrease the rotation rates of the first back roller, the second back roller, the third back roller, or/and the fourth back roller to dynamically adjust the linear density or/and blending ratio for the segment i of yarn Y.

5) Let $\rho_1 = \rho_2 = \rho_3 = \rho_4 = \rho$ the Equation (6) can be simplified as $$\rho_{yi} = \frac{\rho}{e_q} * \frac{V_{h1i} + V_{h2i} + V_{h3i} + V_{h4i}}{V_z}. \quad (8)$$

According to Equations (2)-(5) and (7)-(8), the linear speeds $V_{h1i}$, $V_{h2i}$, $V_{h3i}$, $V_{h4i}$ of the first back roller, the second back roller, the third back roller, and the fourth back roller are calculated. Based on the reference linear speeds $V_{h10}$, $V_{h20}$, $V_{h30}$, and $V_{h40}$, the rotation rates of the first back roller, the second back roller, the third back roller, or/and the fourth back roller are increased or decreased to reach the preset linear density and blending ratio for the segment i of the yarn Y.

6) At the moment of switching the segment i−1 to the segment i of yarn Y, let the linear density of the yarn Y increase by dynamic increment $\Delta\rho_{yi}$, i.e., thickness change $\Delta\rho_{yi}$, on the basis of the reference linear density; and thus the first back roller, the second back roller, the third back roller and the fourth back roller have corresponding increments on the basis of the reference linear speed, i.e., when $(V_{h10} + V_{h20} + V_{h30} + V_{h40}) \rightarrow (V_{h10} + \Delta V_{h1i} + V_{h20} + \Delta V_{h2i} + V_{h30} + \Delta V_{h3i} + V_{h40} + \Delta V_{h4i})$, the linear density increment of yarn Y is:

$$\Delta\rho_{yi} = \frac{\rho}{e_q * V_z} * (\Delta V_{h1i} + \Delta V_{h2i} + \Delta V_{h3i} + \Delta V_{h4i});$$

Then the linear density $\rho_{yi}$ of the yarn Y is expressed as $$\rho_{yi} = \rho_{y0} + \Delta\rho_{yi} = \rho_{y0} + \frac{\Delta V_{h1i} + \Delta V_{h2i} + \Delta V_{h3i} + \Delta V_{h4i}}{V_z} * \frac{\rho}{e_q} \quad (9)$$

Let $\Delta V_i=\Delta V_{h1i}+V_{h2i}+\Delta V_{h31}+\Delta V_{h4i}$, then Equation 9) is simplified as:

$$\rho_{yi} = \rho_{y0} + \frac{\Delta V_i}{V_z} * \frac{\rho}{e_q} \tag{10}$$

The linear density of the yarn Y can be adjusted by controlling the sum of the linear speed increments $\Delta V_i$ of the first back roller, the second back roller, the third back roller, the fourth back roller.

7) Let $\rho_1=\rho_2=\rho_3=\rho_4=\rho$, at the moment of switching the segment i−1 to the segment i of the yarn Y, the blending ratios of the yarn Y in Equations (2)-(6) can be simplified as:

$$k_{1i} = \frac{V_{h10} + \Delta V_{h1i}}{V_z + \Delta V_i} \tag{11}$$

$$k_{2i} = \frac{V_{h20} + \Delta V_{h2i}}{V_z + \Delta V_i} \tag{12}$$

$$k_{3i} = \frac{V_{h30} + \Delta V_{h3i}}{V_z + \Delta V_i} \tag{13}$$

$$k_{4i} = \frac{V_{h40} + \Delta V_{h4i}}{V_z + \Delta V_i} \tag{14}$$

The blending ratios of the yarn Y can be adjusted by controlling the linear speed increments of the first back roller, the second back roller, the third back roller, the fourth back roller;

wherein $$\Delta V_{h1i}=k_{1i}*(V_Z+\Delta V_i)-V_{h10}$$

$$\Delta V_{h2i}=k_{2i}*(V_Z+\Delta V_i)-V_{h20}$$

$$\Delta V_{h3i}=k_{3i}*(V_Z+\Delta V_i)-V_{h30}$$

$$\Delta V_{h4i}=k_{4i}*(V_Z+\Delta V_i)-V_{h40}$$

8) Let $V_{h1i}*\rho_1+V_{h2i}*\rho_2+V_{h3i}*\rho_3+V_{h4i}*\rho_4=H$ and H is a constant, then $\Delta V_i$ is constantly equal to zero, and thus the linear density is unchanged when the blending ratios of the yarn Y are adjusted.

9) Let any one to three of $\Delta V_{h1i}$, $\Delta V_{h2i}$, $\Delta V_{h3i}$, and $\Delta V_{h4i}$ be equal to zero, while the remaining ones are not zero, then the one to three roving yarn ingredients can be changed while the other roving yarn ingredients are unchanged. The adjusted blending ratio are:

$$k_{ki} = \frac{V_{hk0} + \Delta V_{hki}}{V_z + \Delta V_i}$$

$$k_{ji} = \frac{V_{hj0}}{V_z + \Delta V_i}$$

wherein k, j∈(1,2,3,4,5) and k≠j.

10) Let none of $\Delta V_{h1i}$, $\Delta V_{h2i}$, $\Delta V_{h3i}$, and $\Delta V_{h4i}$ be equal to zero, then the four roving yarn ingredients in the yarn Y may be changed.

11) Let any one to three of $\Delta V_{h1i}$, $\Delta V_{h2i}$, $\Delta V_{h3i}$, and $\Delta V_{h4i}$ be equal to zero, while the remaining ones are not zero, then the one to three roving yarn ingredients of the segment i of the yarn Y may be discontinuous.

Embodiment 4

The method of dynamically configuring linear density and blending ratio of a yarn by four-ingredient asynchronous drafting disclosed in this embodiment is substantially the same as Embodiment 3, and the differences are:

Set the initial linear speeds of the first back roller, a second back roller, a third back roller, and a fourth back roller as $V_{h10}$, $V_{h20}$, $V_{h30}$, $V_{h40}$; the initial linear speed of the middle roller $V_{Z0}=V_{h10}+V_{h20}+V_{h30}+V_{h40}$.

In addition, set $V_{Zi}=V_{h1(i-1)}+V_{h2(i-1)}+V_{h3(i-1)}+V_{h4(i-1)}$, and let the two-stage drafting ratio $$e_{qi} = \frac{V_{qi}}{V_{zi}}$$

constantly be equal to the set value $e_q$;

When drafting and blending the segment i of the yarn Y, take the linear density and the blending ratio of the segment i−1 as a reference linear density and a reference blending ratio of segment i. On the premise of the known set linear density $\rho_{yi}$ and blending ratios $k_{1i}$, $k_{2i}$, $k_{3i}$, $k_{4i}$, the linear speeds $V_{h1i}$, $V_{h2i}$, $V_{h3i}$, $V_{h4i}$ of a first back roller, a second back roller, a third back roller, and a fourth back roller are calculated.

On the basis of the segment i−1, the rotation rates of the first back roller and/or the second back roller are adjusted to dynamically regulate the linear density or/and blending ratio of segment i of the yarn Y on line.

In the method, $V_{Zi}=V_{h1(i-1)}+V_{h2(i-1)}+V_{h3(i-1)}+V_{h4(i-1)}$ and the two-stage drafting ratio is constant, and thus the speeds of the middle roller and the front roller are continually adjusted with the speeds of the back rollers, to avoid a substantial change of the drafting ratio of the yarn resulted from untimely adjusted speeds of the middle roller and the front roller as opposed to a relatively large speed adjustment of the combination of the back rollers, and effectively prevent yarn breakage.

In addition, the operating speed of each roller is recorded in real time by a computer or other intellectual control unit, and thus the speeds of the middle roller and the front roller in the next step can be automatically calculated if the current speeds of the back rollers are known. The speed increments/decrements of the combination of the back rollers are calculated quickly with the above equations and models, to adjust the set blending ratio and linear density more easily and accurately.

Embodiment 5

A device for spinning a multi-color slub yarn and a dotted yarn by four-ingredient two-stage drafting, comprises a control system and an actuating mechanism. The actuating mechanism includes four-ingredient separate/integrated asynchronous/synchronous two-stage drafting mechanism, a twisting mechanism and a winding mechanism; the two-stage drafting mechanism includes a first stage drafting unit and a second stage drafting unit.

As shown in FIGS. 1 and 2, the first stage drafting unit includes combination 15 of back rollers and middle roller 3; combination 15 of back rollers has four rotational degrees of freedom and includes first back roller 6, second back roller 8, third back roller 10, and fourth back roller 12, which are set abreast on a same back roller shaft 21. The second stage drafting unit includes front roller 1 and middle roller 3. The numeral 4 refers to a top roller corresponding to middle roller 3, and the numerals 5, 7, 9, and 11 refer to four top rollers corresponding to the four back rollers. The numeral 2 refers to a top roller corresponding to front roller 1, 23, 26 and 27 are bearings.

As shown in FIG. 2, a four-nested combination of back rollers with four rotational degrees of freedom is provided. The four movable back rollers 6, 8, 10, 12 are movably placed around the same core shaft 21 and respectively driven by pulleys 30, 32, 20, 24. The four back rollers are adjacently provided in sequence and the driving pulleys 30, 32, 20, 24 are located on both sides of the four back rollers.

Figure 5:
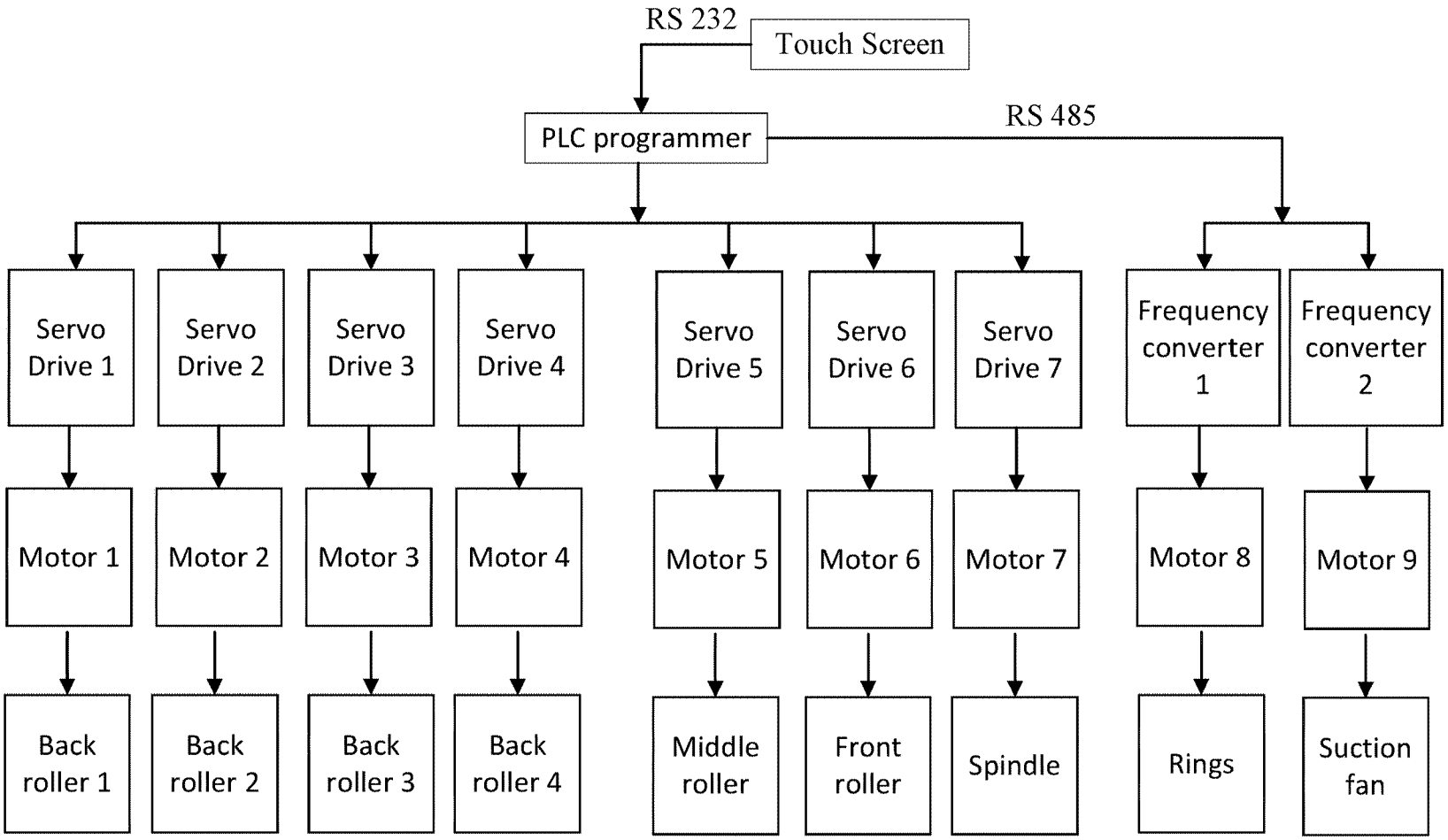
FIG. 5 is a structural schematic diagram of a control system.

As shown in FIG. 5, the control system mainly includes a PLC programmable controller, a servo driver, a servo motor, Recommended Standard (RS) 232 serial port, RS 485 serial port, etc.

The PLC programmable controller controls the motor by the servo driver, to drive the rollers, rings and spindles.

The four back rollers are set abreast on a same back roller shaft, with the driving mechanisms set on both sides, which makes the mechanic structure more compact and the four types of roving yarns drafted by the four back rollers more close when blending, so as to effectively prevent the yarn from interferences and pollutions when the driving mechanisms work. In addition, the four basic colors yarns go through the bell mouth with a smaller clamping angle, rendering the blending of the yarn more even and almost unbreakable.

TABLE 2

Parameter comparison between asynchronous drafting and synchronous drafting (taking 18.45 tex cotton yarn as an example)

| | Synchronous drafting for single ingredient spinning | | Synchronous drafting for double ingredients spinning | | Synchronous drafting for double ingredients spinning | | Asynchronous drafting for four ingredients spinning | | | |
|---|---|---|---|---|---|---|---|---|---|---|
| | | | Ingredient 1 | Ingredient 2 | Ingredient 1 | Ingredient 2 | Ingredient 1 | Ingredient 2 | Ingredient 3 | Ingredient 4 |
| Roving yarn weight (g/5 m) | 5.0 | | 5.0 | 5.0 | 5.0 | 5.0 | 5.0 | 5.0 | 5.0 | 5.0 |
| Back area drafting ratio | 1.1-1.3 | 1.1-1.3 | 1.1-1.3 | 1.1-1.3 | 1.1-1.3 | 1.1-1.3 | 4*(k1 + k2 + k3 + k4)/k1 Changes with the blending ratio | 4*(k1 + k2 + k3 + k4)/k1 Changes with the blending ratio | 4*(k1 + k2 + k3 + k4 + k5)/k1 Changes with the blending ratio | 4*(k1 + k2 + k3 + k4)/k1 Changes with the blending ratio |
| Front area drafting ratio | 24.6-20.8 | 22.7 | 49.2-41.6 | 45.4 | 45.4 | 45.4 | 108.4 | 108.4 | 108.4 | 108.4 |
| Back rollers speed | unchanged | changed | unchanged | | changed | — | Asynchronous change | Asynchronous unchange | Asynchronous unchange | Asynchronous change |
| Middle roller speed | unchanged | unchanged | unchanged | | unchanged | | unchanged | | | |
| Front roller speed | unchanged | unchanged | unchanged | | unchanged | | unchanged | | | |
| Average spinning number (tex) | 18.45 | 18.45 | 18.45 | | 18.45 | | 18.45 | | | |
| Linear speed variable | invariable | Limitedly variable | invariable | | Limitedly variable | | Variable, adjustable | | | |
| Blending ratio variable | invariable | invariable | invariable | | Limitedly variable | | Variable, adjustable | | | |
| Linear speed and blending ratio both variable | invariable | invariable | invariable | | Limitedly variable | | Variable, adjustable | | | |
| Spinning effect | Even yarn | Slub yarn | Even yarn | | Limited segmented color Limited slub yarn | | Even yarn Any blending ratio Color-blended yarn | Even yarn Any blending ratio Segment-color blended yarn | Even yarn Any blending ratio Segment-color slub yarn | Even yarn Any blending ratio slub yarn |

Several preferable embodiments are described, in combination with the accompanying drawings. However, the invention is not intended to be limited herein. Any improvements and/or modifications by the skilled in the art, without departing from the spirit of the invention, would fall within protection scope of the invention.

What is claimed is:

1. A method of dynamically configuring a linear density and a blending ratio of a yarn by four-ingredient asynchronous drafting, comprising:

1) an actuating mechanism includes a four-ingredient asynchronous/synchronous two-stage drafting mechanism, a twisting mechanism and a winding mechanism; the four-ingredient asynchronous/synchronous two-stage drafting mechanism includes a first stage asynchronous drafting unit and a successive second stage synchronous drafting unit;

2) the first stage asynchronous drafting unit includes a combination of back rollers and a middle roller; the combination of back rollers has four rotational degrees of freedom and includes a first back roller, a second back roller, a third back roller, and a fourth back roller, which are set abreast on a same back roller shaft; the first back roller, the second back roller, the third back roller, and the fourth back roller move at speeds of $V_{h1}$, $V_{h2}$, $V_{h3}$, and $V_{h4}$ respectively; the middle roller rotates at a speed of $V_z$; the second stage synchronous drafting unit includes a front roller and the middle roller; the front roller rotates at a surface linear speed of $V_q$;

assuming linear densities of a first roving yarn ingredient, a second roving yarn ingredient, a third roving yarn ingredient, and a fourth roving yarn ingredient drafted by the first back roller, the second back roller, the third back roller, and the fourth back roller are respectively $\rho_1$, $\rho_2$, $\rho_3$, and $\rho_4$, the linear density of the yarn Y drafted and twisted by the front roller is $\rho_y$;

$$\rho_y = \frac{1}{V_q}(V_{h1} * \rho_1 + V_{h2} * \rho_2 + V_{h3} * \rho_3 + V_{h4} * \rho_4) \tag{1}$$

blending ratios of the first roving yarn ingredient, the second roving yarn ingredient, the third roving yarn ingredient, and the fourth roving yarn ingredient are respectively $k_1$, $k_2$, $k_3$, and $k_4$, $$k_1 = \frac{\rho_1''}{\rho_1'' + \rho_2'' + \rho_3'' + \rho_4''} = \frac{\rho_1'}{\rho_1' + \rho_2' + \rho_3' + \rho_4'} = \frac{\rho_1 * V_{h1}}{\rho_1 * V_{h1} + \rho_2 * V_{h2} + \rho_3 * V_{h3} ++ \rho_4 * V_{h4}}$$

$$k_2 = \frac{\rho_2''}{\rho_1'' + \rho_2'' + \rho_3'' + \rho_4''} = \frac{\rho_2'}{\rho_1' + \rho_2' + \rho_3' + \rho_4'} = \frac{\rho_2 * V_{h2}}{\rho_1 * V_{h1} + \rho_2 * V_{h2} + \rho_3 * V_{h3} ++ \rho_4 * V_{h4}}$$

$$k_3 = \frac{\rho_3''}{\rho_1'' + \rho_2'' + \rho_3'' + \rho_4''} = \frac{\rho_3'}{\rho_1' + \rho_2' + \rho_3' + \rho_4'} = \frac{\rho_3 * V_{h3}}{\rho_1 * V_{h1} + \rho_2 * V_{h2} + \rho_3 * V_{h3} ++ \rho_4 * V_{h4}}$$

$$k_4 = \frac{\rho_4''}{\rho_1'' + \rho_2'' + \rho_3'' + \rho_4''} = \frac{\rho_4'}{\rho_1' + \rho_2' + \rho_3' + \rho_4'} = \frac{\rho_1 * V_{h1}}{\rho_1 * V_{h1} + \rho_2 * V_{h2} + \rho_3 * V_{h3} ++ \rho_4 * V_{h4}}$$

3) a ratio of linear speeds of the front roller and the middle roller $V_q/V_z$ is kept constant, and speeds of the front roller and the middle roller depend on a reference linear density of the yarn;

4) the linear density or/and a blending ratio K of a yarn Y are dynamically adjusted online, by adjusting rotation rates of the first back roller, the second back roller, the third back roller, and the fourth back roller.

2. The method of claim 1, wherein according to a change of the blending ratio K of the yarn Y with a time t, and a change of the linear density $\rho_y$ of the yarn Y with the time t, a change of surface linear speeds of the first back roller, the second back roller, the third back roller, and the fourth back roller is derived; blending ratios of the first roving yarn ingredient, the second roving yarn ingredient, the third roving yarn ingredient, and the fourth roving yarn ingredient are set respectively as $k_1$, $k_2$, $k_3$, and $k_4$, and ratios of blending ratios of the yarn Y are respectively $K_1$, $K_2$, and $K_3$, $$K_1 = \frac{k_1}{k_2} = \frac{\rho_1 V_{h1}}{\rho_2 V_{h2}}$$

$$K_2 = \frac{k_1}{k_3} = \frac{\rho_1 V_{h1}}{\rho_3 V_{h3}}$$

$$K_3 = \frac{k_1}{k_4} = \frac{\rho_1 V_{h1}}{\rho_4 V_{h4}}$$

the linear density of the yarn Y $$\rho_y = \frac{V_{h1}^* + \rho_1 + V_{h2}^* + \rho_2 + V_{h3}^* + \rho_3 + V_{h4}^* + \rho_4}{V_q}$$

then a surface linear speed of the first back roller is $$V_{h1} = \frac{\rho_y V_q}{\rho_1\left(1 + \frac{1}{K_1} + \frac{1}{K_2} + \frac{1}{K_3}\right)}$$

a surface linear speed of the second back roller is $$V_{h2} = \frac{\rho_y V_q}{\rho_2\left(1 + K_1 + \frac{K_1}{K_2} + \frac{K_2}{K_3}\right)}$$

a surface linear speed of the third back roller is $$V_{h3} = \frac{\rho_y V_q}{\rho_3\left(1 + K_2 + \frac{K_2}{K_1} + \frac{K_2}{K_3}\right)}$$

a surface linear speed of the fourth back roller is $$V_{h4} = \frac{\rho_y V_q}{\rho_4\left(1 + K_3 + \frac{K_3}{K_1} + \frac{K_3}{K_2}\right)}$$

wherein $\rho_1$, $\rho_2$, $\rho_3$, and $\rho_4$ are constants, and $K_i$ and $\rho_y$ are functions changing with the time t.

3. The method of claim 1, wherein assuming $\rho_1=\rho_2=\rho_3=\rho_4=\rho$, then:

1) a speed of any one of the first back roller, the second back roller, the third back roller and the fourth back roller is changed, and speeds of the other three back rollers are kept unchanged, and then a yarn ingredient drafted by the any one of back rollers and a linear density thereof change, and the linear density $p'_y$ of the yarn Y is adjusted as:

$$\rho'_y = \rho_y + \Delta\rho_y = \frac{\rho}{V_q} * (V_{h1} + V_{h2} + V_{h3} + V_{h4} + \Delta V_{h4})$$

or $$\rho'_y = \rho_y + \Delta\rho_y = \frac{\rho}{V_q} * (V_{h1} + V_{h2} + V_{h3} + V_{h4} + \Delta V_{h3})$$

or $$\rho'_y = \rho_y + \Delta\rho_y = \frac{\rho}{V_q} * (V_{h1} + V_{h2} + V_{h3} + V_{h4} + \Delta V_{h2})$$

or $$\rho'_y = \rho_y + \Delta\rho_y = \frac{\rho}{V_q} * (V_{h1} + V_{h2} + V_{h3} + V_{h4} + \Delta V_{h1})$$

wherein $\Delta\rho_y$ is a linear density change of the yarn, $\Delta V_{h1}$, $\Delta V_{h2}$, $\Delta V_{h3}$ and $\Delta V_{h4}$ is a speed change of the first, second, third and fourth back roller respectively;

2) speeds of any two back rollers of the first back roller, the second back roller, the third back roller, and the fourth back roller are changed, and speeds of the other two back rollers are kept unchanged, two yarn ingredients drafted by the any two back rollers and linear densities thereof change, and the linear density $\rho'_y$ of the yarn Y is adjusted as:

$$\rho'_y = \rho_y + \Delta\rho_y = \frac{\rho}{V_q} * [V_{h1} + V_{h2} + V_{h3} + V_{h4} + (\Delta V_{h1} + \Delta V_{h2})]$$

or $$\rho'_y = \rho_y + \Delta\rho_y = \frac{\rho}{V_q} * [V_{h1} + V_{h2} + V_{h3} + V_{h4} + (\Delta V_{h1} + \Delta V_{h4})]$$

or $$\rho'_y = \rho_y + \Delta\rho_y = \frac{\rho}{V_q} * [V_{h1} + V_{h2} + V_{h3} + V_{h4} + (\Delta V_{h1} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h2} + \Delta V_{h4})]$$

or $$\rho'_y = \rho_y + \Delta\rho_y = \frac{\rho}{V_q} * [V_{h1} + V_{h2} + V_{h3} + V_{h4} + (\Delta V_{h3} + \Delta V_{h4})]$$

3) speeds of any three back rollers of the first back roller, the second back roller, the third back roller and the fourth back roller are changed, and speeds of the other back rollers are kept unchanged, three yarn ingredients drafted by the any three back rollers and the linear densities thereof change, and the linear density $\rho'_y$ of the yarn Y is adjusted as:

$$\rho'_y = \rho_y + \Delta\rho_y = \frac{\rho}{V_q} * [V_{h1} + V_{h2} + V_{h3} + V_{h4} + (\Delta V_{h1} + \Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h4} + \Delta V_{h2} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h4} + \Delta V_{h1} + \Delta V_{h3})]$$

or $$\rho'_y = \rho_y + \Delta\rho_y = \frac{\rho}{V_q} * [V_{h1} + V_{h2} + V_{h3} + V_{h4} + (\Delta V_{h4} + \Delta V_{h2} + \Delta V_{h1})].$$

4) speeds of the first back roller, the second back roller, the third back roller, and the fourth back roller are changed simultaneously, and a sum of speeds of four back rollers is unequal to zero, yarn ingredients drafted by the four back rollers and linear densities thereof change, and the linear density $\rho'_y$ of the yarn Y is adjusted as:

$$\rho'_y = \rho_y + \Delta\rho_y = \frac{\rho}{V_q} * [V_{h1} + V_{h2} + V_{h3} + V_{h4} + (\Delta V_{h1} + \Delta V_{h2} + \Delta V_{h3} + \Delta V_{h4})].$$

4. The method of claim 3, wherein speeds of the first back roller, the second back roller, the third back roller, and the fourth back roller are changed, and a speed of any one of back rollers is equal to zero, while speeds of other three back rollers are unequal to zero, a yarn ingredient drafted by the any one of back rollers is discontinuous, while other three yarn ingredients are continuous, and the linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{h1} + \Delta V_{h1}) + (V_{h2} + \Delta V_{h2}) + (V_{h3} + \Delta V_{h3})] \quad (T_1 \le t \le T_2)$$

or $$\rho'_y = \frac{\rho}{V_q} * [(V_{h1} + \Delta V_{h1}) + (V_{h4} + \Delta V_{h4}) + (V_{h3} + \Delta V_{h3})] \quad (T_1 \le t \le T_2)$$

or $$\rho'_y = \frac{\rho}{V_q} * [(V_{h4} + \Delta V_{h4}) + (V_{h2} + \Delta V_{h2}) + (V_{h3} + \Delta V_{h3})] \quad (T_1 \le t \le T_2)$$

or $$\rho'_y = \frac{\rho}{V_q} * [(V_{h1} + \Delta V_{h1}) + (V_{h2} + \Delta V_{h2}) + (V_{h4} + \Delta V_{h4})] \quad (T_1 \le t \le T_2)$$

wherein $T_1$, and $T_2$ are time points, and t is a time variable.

5. The method of claim 3, wherein speeds of the first back roller, the second back roller, the third back roller, the fourth back roller, and speeds of any two back rollers are equal to zero, while speeds of other two back rollers are unequal to zero, and the yarn ingredients drafted by the any two back rollers are discontinuous, while other two yarn ingredients are continuous, and the linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hi} + \Delta V_{hi}) + (V_{hj} + \Delta V_{hj})] \; (T_1 \le t \le T_2)$$

wherein $T_1$, and $T_2$ are time points, t is a time variable, i≠j and i,j∈(1,2,3,4).

6. The method of claim 3, wherein speeds of the first back roller, the second back roller, the third back roller and the fourth back roller are changed, and speeds of any three back rollers are equal to zero, while speeds of other one back roller is unequal to zero, three yarn ingredients drafted by the any three back rollers are discontinuous, while the other yarn ingredients are continuous, and the linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hj} + \Delta V_{hj})] \; (T_1 \le t \le T_2)$$

wherein $T_1$, and $T_2$ are time points, t is a time variable, and j∈(1,2,3,4).

7. The method of claim 3, wherein the speeds of the first back roller, the second back roller, the third back roller, and the fourth back roller are changed, and speeds of any two back rollers are equal to zero successively, while speeds of other back rollers are unequal to zero, and yarn ingredients drafted by the any two back rollers are discontinuous successively, while other yarn ingredients are continuous, and the linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hi} + \Delta V_{hi}) + (V_{hj} + \Delta V_{hj}) + (V_{hk} + \Delta V_{hk})] \; (T_1 \le t \le T_2)$$

$$\rho'_y = \frac{\rho}{V_q} * [(V_{hi} + \Delta V_{hi}) + (V_{hj} + \Delta V_{hj})] \; (T_2 \le t \le T_3)$$

wherein $T_1$, $T_2$ and $T_3$ are time points, t is a time variable, i≠j≠k and i,j,k∈(1,2,3,4).

8. The method of claim 3, wherein the speeds of the first back roller, the second back roller, the third back roller, and the fourth back roller are changed, and speeds of any three back rollers are equal to zero successively, while speeds of the other back rollers are unequal to zero, and yarn ingredients drafted by the any three back rollers are discontinuous successively, while other yarn ingredients are continuous, and the linear density $\rho'_y$ of the yarn Y is adjusted as:

$$\rho'_y = \frac{\rho}{V_q} * [(V_{h1} + \Delta V_{h1}) + (V_{h2} + \Delta V_{h2}) + (V_{h3} + \Delta V_{h3}) + (V_{h4} + \Delta V_{h4})] \quad (0 \le t \le T_1)$$

$$\rho'_y = \frac{\rho}{V_q} * [(V_{hi} + \Delta V_{hi}) + (V_{hj} + \Delta V_{hj}) + (V_{hk} + \Delta V_{hk})] \; (T_1 \le t \le T_2)$$

$$\rho'_y = \frac{\rho}{V_q} * [(V_{hi} + \Delta V_{hi}) + (V_{hj} + \Delta V_{hj})] \; (T_2 \le t \le T_3)$$

$$\rho'_y = \frac{\rho}{V_q} * [(V_{hi} + \Delta V_{hi})] \; (T_3 \le t \le T_4)$$

wherein $T_1$, $T_2$ $T_3$ and $T_4$ are time points, and t is a time variable, i≠j≠k and i,j,k∈(1,2,3,4).

9. The method of claim 3, wherein the speeds of the first back roller, the second back roller, the third back roller, and the fourth back roller are changed, and $V_{h1}*\rho_1+V_{h2}*\rho_2+V_{h3}*\rho_3+V_{h4}*\rho_4$ are a constant, and $\rho_1=\rho_2=\rho_3=\rho_4=\rho$ then the linear density of the yarn Y is unchanged while the blending ratios of the ingredients change; the blending ratios $k_1$, $k_2$, $k_3$, $k_4$ of the first yarn ingredient, the second yarn ingredient, the third yarn ingredient, and the fourth yarn ingredient are provided as below:

$$k_j = \frac{V_{hj} + \Delta V_{hj}}{V_{h1} + \Delta V_{h1} + V_{h2} + \Delta V_{h2} + V_{h3} + \Delta V_{h3} + V_{h4} + \Delta V_{h4}}$$

wherein j∈(1,2,3,4).

10. The method of claim 1, wherein according to the set blending ratio and/or linear density, the yarn Y is divided into n segments; then a linear density and a blending ratio of each segment of yarn Y are the same, while linear densities and blending ratios of adjacent segments are different; when drafting the segment i of the yarn Y, linear speeds of the first back roller, the second back roller, the third back roller, and the fourth back roller are $V_{h1i}$, $V_{h2i}$, $V_{h3i}$, $V_{h4i}$, wherein i∈(1, 2, . . . , n); the first roving yarn ingredient, the second roving yarn ingredient, the third roving yarn ingredient, and the fourth roving yarn ingredient are two-stage drafted and twisted to form segment i of yarn Y, and blending ratios $k_{1i}$, $k_{2i}$, $k_{3i}$, and $k_{4i}$ thereof are:

$$k_{1i} = \frac{\rho_1 * V_{h1i}}{p_1 * V_{h1i} + p_2 * V_{h2i} + p_3 * V_{h3i} + p_4 * V_{h4i}} \tag{2}$$

$$k_{2i} = \frac{\rho_2 * V_{h2i}}{p_1 * V_{h1i} + p_2 * V_{h2i} + p_3 * V_{h3i} + p_4 * V_{h4i}} \tag{3}$$

$$k_{3i} = \frac{\rho_3 * V_{h3i}}{p_1 * V_{h1i} + p_2 * V_{h2i} + p_3 * V_{h3i} + p_4 * V_{h4i}} \tag{4}$$

$$k_{4i} = \frac{\rho_4 * V_{h4i}}{p_1 * V_{h1i} + p_2 * V_{h2i} + p_3 * V_{h3i} + p_4 * V_{h4i}} \tag{5}$$

the linear density of the segment i of the yarn Y is:

$$\rho_{y1} = \frac{V_z}{V_q} * \left(\frac{V_{h1i}}{V_z} * \rho_1 + \frac{V_{h2i}}{V_z}\rho_2 + \frac{V_{h3i}}{V_z}\rho_3 + \frac{V_{h4i}}{V_z}\rho_4\right) = \frac{1}{e_q} * \left(\frac{V_{h1i}}{V_z} * \rho_1 + \frac{V_{h2i}}{V_z}\rho_2 + \frac{V_{h3i}}{V_z}\rho_3 + \frac{V_{h4i}}{V_z}\rho_4\right) \tag{6}$$

wherein $$e_q = \frac{V_q}{V_z}$$

is a two-stage drafting ratio;

(1) a segment with the lowest density is taken as a reference segment, whose reference linear density is $\rho_0$; reference linear speeds of the first back roller, the second back roller, the third back roller, and the fourth back roller for the reference segment are respectively $V_{h10}$, $V_{h20}$, $V_{h30}$, and $V_{h40}$; and reference blending ratios of the first roving yarn ingredient, the second roving yarn ingredient, the third roving yarn ingredient, and the fourth roving yarn ingredient for the reference segment are respectively $k_{10}$, $k_{20}$, $k_{30}$, and $k_{40}$, a linear speed of the middle roller is kept constant, and $$V_Z = V_{h10} + V_{h20} + V_{h30} + V_{h40} \quad (7);$$

and the two-stage drafting ratio $$e_q = \frac{V_q}{V_z}$$

is kept constant;

wherein reference linear speeds of the first back roller, the second back roller, the third back roller, and the fourth back roller for the reference segment are respectively $V_{h10}$, $V_{h20}$, $V_{h30}$, and $V_{h40}$, which are predetermined according to a material, a reference linear density $\rho_0$ and a reference blending ratios $k_{10}$, $k_{20}$, $k_{30}$ and $k_{40}$ of the first roving yarn ingredient, the second roving yarn ingredient, the third roving yarn ingredient, and the fourth roving yarn ingredient;

(2) when the segment i of the yarn Y is drafted and blended, on a premise of known set linear density $\rho_{yi}$ and blending ratios $k_{1i}$, $k_{2i}$, $k_{3i}$, and $k_{4i}$, linear speeds $V_{h1i}$, $V_{h2i}$, $V_{h3i}$ and $V_{h4i}$ of the first back roller, the second back roller, the third back roller, and the fourth back roller are calculated according to equations (2)-(7);

(3) based on reference linear speeds $V_{h10}$, $V_{h20}$, $V_{h30}$, and $V_{h40}$ for the reference segment, rotation rates of the first back roller, the second back roller, the third back roller, or/and the fourth back roller are increased/decreased to dynamically adjust the linear density or/and the blending ratio for the segment i of the yarn Y.

11. The method of claim 10, wherein $\rho_1=\rho_2=\rho_3=\rho_4=\rho$, equation (6) is simplified as $$\rho_{yi} = \frac{\rho}{e_q} * \frac{V_{h11} + V_{h21} + V_{h31} + V_{h41}}{V_z} \quad (8)$$

according to equations (2)-(5) and (7)-(8), linear speeds $V_{h1i}$, $V_{h2i}$, $V_{h3i}$, $V_{h4i}$ of the first back roller, the second back roller, the third back roller and the fourth back roller are calculated; based on reference linear speeds $V_{h10}$, $V_{h20}$, $V_{h30}$, $V_{h40}$, rotation rates of the first back roller, the second back roller, the third back roller, or/and the fourth back roller are increased or decreased to reach a preset linear density and blending ratio for the segment i of the yarn Y.

12. The method of claim 10, wherein at a moment of switching segment i−1 to segment i of the yarn Y, the linear density of the yarn Y is increased by dynamic increment $\Delta\rho_{yi}$, i.e., linear density change $\Delta\rho_{yi}$, on a basis of the reference linear density; and the first back roller, the second back roller, the third back roller and the fourth back roller have corresponding increments on a basis of the reference linear speed, when $(V_{h10}+V_{h20}+V_{h30}+V_{h40}) \rightarrow (V_{h10}+\Delta_{h1i}+V_{h20}+\Delta V_{h2i}+V_{h30}+\Delta V_{h3i}+V_{h40}+\Delta V_{h4i})$ a linear density increment of the yarn Y is:

$$\Delta\rho_{yi} = \frac{\rho}{e_q V_z} * (\Delta V_{h1i} + \Delta V_{h2i} + \Delta V_{h3i} + \Delta V_{h4i}):$$

the linear density $\rho_{yi}$ of the yarn Y is $$\rho_{yi} = \rho_{y0} + \Delta\rho_{yi} = \rho_{y0} + \frac{\Delta V_{h1i} + \Delta V_{h2i} + \Delta V_{h3i} + \Delta V_{h4i}}{V_z} * \frac{\rho}{e_q} \quad (9)$$

let $\Delta V_i = \Delta V_{h1i} + \Delta V_{h2i} + \Delta V_{h3i} + \Delta V_{h4i}$, then equation (9) is simplified as:

$$\rho_{yi} = \rho_{y0} + \frac{\Delta V_i}{V_z} * \frac{\rho}{e_q} \quad (10)$$

the linear density of the yarn Y is adjusted by controlling a sum of linear speed increments $\Delta V_i$ of the first back roller, the second back roller, the third back roller, and the fourth back roller.

13. The method of claim 12, wherein $\rho_1=\rho_2=\rho_3=_4=\rho$, at a moment of switching the segment i−1 to the segment i of the yarn Y, blending ratios of the yarn Y in equations (2)-(5) are simplified as:

$$k_{1i} = \frac{V_{h10} + \Delta V_{h1i}}{V_z + \Delta V_i} \quad (11)$$

$$k_{2i} = \frac{V_{h20} + \Delta V_{h2i}}{V_z + \Delta V_i} \quad (12)$$

$$k_{3i} = \frac{V_{h30} + \Delta V_{h3i}}{V_z + \Delta V_i} \quad (13)$$

$$k_{4i} = \frac{V_{h40} + \Delta V_{h4i}}{V_z + V_i} \quad (14)$$

blending ratios of the yarn Y are adjusted by controlling linear speed increments of the first back roller, the second back roller, the third back roller, the fourth back roller;

wherein $$\Delta V_{h1i} = k_{1i} * (V_Z + \Delta V_i) - V_{h10}$$

$$\Delta V_{h2i} = k_{2i} * (V_Z + \Delta V_i) - V_{h20}$$

$$\Delta V_{h3i} = k_{3i} * (V_Z + \Delta V_i) - V_{h30}$$

$$\Delta V_{h4i} = k_{4i} * (V_Z + \Delta V_i) - V_{h40}.$$

14. The method of claim 12, wherein $$V_{h1i} * \rho_1 + V_{h2i} * \rho_2 + V_{h3i} * \rho_3 + V_{h4i} * \rho_4 = H,$$

H is a constant, and $\Delta V_i$ is constantly equal to zero, the linear density is unchanged when the blending ratios of the yarn Y are adjusted.

15. The method of claim 12, wherein any one to three of $\Delta V_{h1i}$, $\Delta V_{h2i}$, $\Delta V_{h3i}$, and $\Delta V_{h4i}$ are equal to zero, while the remaining ones are not zero, and one to three roving yarn ingredients are changed while the other rovings ingredients are unchanged, and the adjusted blending ratios are:

$$k_{ki} = \frac{V_{hk0} + \Delta V_{hki}}{V_z + \Delta V_i}$$

$$k_{ji} = \frac{V_{hj0}}{V_z + \Delta V_i}$$

wherein k, j∈(1,2,3,4) and k≠j.

16. The method of claim 12, wherein none of $\Delta V_{h1i}$, $\Delta V_{h2i}$, $\Delta V_{h3i}$, and $\Delta V_{h4i}$ are equal to zero, and the four roving yarn ingredients in the yarn Y change.

17. The method of claim 12, wherein any one to three of $\Delta V_{h1i}$, $\Delta V_{h2i}$, $\Delta V_{h3i}$, and $\Delta V_{h4i}$ is equal to zero, while the remaining ones are not zero, then the one to three roving yarn ingredients of the segment i of the yarn Y are discontinuous.

18. The method of claim 1, wherein yellow roving yarns, magenta roving yarns, cyan roving yarns, and black yarns are respectively drafted by the first back roller, the second back roller, the third back roller, and the fourth back roller; a speed $V_q$ of the front roller is kept constant and speeds of the first back roller, the second back roller, the third back roller, and the fourth back roller are adjusted to regulate colors of the yarns; when blending colors, a concentration or brightness and a hue is adjusted with a proportion of black color.

19. A device for implementing a method of dynamically configuring a linear density and a blending ratio of a yarn by four-ingredient asynchronous drafting and dynamically configuring a linear density and a blending ratio of a yarn by four-ingredient asynchronous/synchronous drafting, comprising:

a control system, and an actuating mechanism, wherein the actuating mechanism includes a four-ingredient separate/integrated asynchronous/synchronous two-stage drafting mechanism, a twisting mechanism and a winding mechanism; the two-stage drafting mechanism includes a first stage drafting unit and a second stage drafting unit;

the first stage drafting unit includes a combination of back rollers and a middle roller; the combination of back rollers has four rotational degrees of freedom and includes a first back roller, a second back roller, a third back roller, and a fourth back roller, which are set abreast on a same back roller shaft; four back rollers are adjacently provided in sequence and driving pulleys thereof are located on both sides of the four back rollers; the second stage drafting unit includes a front roller and a middle roller.

20. The device of claim 19, wherein any one of the four back roller is fixedly set on the back roller shaft; other three back rollers are respectively symmetrically set on the back roller shaft and independently rotatable with each other.

21. The device of claim 20, wherein the third back roller is fixed on the back roller shaft and the other three back rollers are respectively symmetrically set on the back roller shaft and independently rotatable with each other; the second back roller has a second sleeve connected to a driving mechanism of the second back roller, and the second sleeve is sleeved around the back roller shaft, and the first back roller is rotatably sleeved around the second sleeve.

* * * * *